US007981011B1

(12) United States Patent
Batca

(10) Patent No.: US 7,981,011 B1
(45) Date of Patent: Jul. 19, 2011

(54) COMBINATION EXERCISE MACHINE

(76) Inventor: Roger Batca, Durham, NC (US)

( * ) Notice: Subject to any disclaimer, the term of this patent is extended or adjusted under 35 U.S.C. 154(b) by 238 days.

(21) Appl. No.: 11/934,922

(22) Filed: Nov. 5, 2007

Related U.S. Application Data

(60) Provisional application No. 60/858,086, filed on Nov. 10, 2006.

(51) Int. Cl.
*A63B 21/062* (2006.01)
*A63B 21/00* (2006.01)

(52) U.S. Cl. ..... 482/100; 482/102; 482/133

(58) Field of Classification Search ..... 482/92–139; 9/100
See application file for complete search history.

(56) References Cited

U.S. PATENT DOCUMENTS 2,470,816 A * 5/1949 Harvey ..... 482/109
3,858,873 A * 1/1975 Jones ..... 482/97
4,411,423 A * 10/1983 Estwanik, III ..... 482/93
4,438,920 A * 3/1984 Veillette ..... 482/46
4,505,475 A * 3/1985 Olschansky et al. ..... 482/100
4,546,967 A * 10/1985 Kecala ..... 482/145
4,600,189 A * 7/1986 Olschansky et al. ..... 482/100
4,624,457 A * 11/1986 Silberman et al. ..... 482/98
4,666,149 A * 5/1987 Olschansky et al. ..... 482/130
4,678,185 A * 7/1987 Mahnke ..... 482/137
4,684,126 A * 8/1987 Dalebout et al. ..... 482/138
4,722,522 A * 2/1988 Lundgren ..... 482/97
4,763,897 A * 8/1988 Yakata ..... 482/100
4,822,038 A * 4/1989 Maag ..... 482/97
4,844,456 A * 7/1989 Habing et al. ..... 482/100
4,858,915 A * 8/1989 Szabo ..... 482/97
4,915,378 A * 4/1990 Abrahamian et al. ..... 482/137
5,060,933 A * 10/1991 Cedro ..... 482/44
5,215,511 A * 6/1993 Cheng ..... 482/121
5,217,422 A * 6/1993 Domzalski ..... 482/138
5,267,930 A * 12/1993 Henes ..... 482/139
5,312,309 A * 5/1994 Fox ..... 482/45
5,356,360 A * 10/1994 Johns ..... 482/99
5,380,261 A * 1/1995 Mora ..... 482/46
5,395,295 A * 3/1995 Ish, III ..... 482/100
5,411,458 A * 5/1995 Giust ..... 482/101
5,419,751 A * 5/1995 Byrd et al. ..... 482/138
5,449,333 A * 9/1995 Carter ..... 482/109
5,533,953 A * 7/1996 Lui et al. ..... 482/96
5,554,086 A * 9/1996 Habing et al. ..... 482/137
5,556,368 A * 9/1996 Akin ..... 482/124
D378,386 S * 3/1997 Brubaker ..... D21/680
5,665,041 A * 9/1997 Hsieh ..... 482/140
5,733,233 A * 3/1998 Webber ..... 482/137
5,776,040 A * 7/1998 Webb et al. ..... 482/98
5,961,428 A * 10/1999 Webber ..... 482/100
6,004,246 A * 12/1999 Sencil ..... 482/96
6,059,701 A * 5/2000 George et al. ..... 482/137
6,099,441 A * 8/2000 Bonnet ..... 482/93
D438,918 S * 3/2001 Batca et al. ..... D21/676
6,203,474 B1 * 3/2001 Jones ..... 482/97
6,264,588 B1 * 7/2001 Ellis ..... 482/137
6,287,241 B1 * 9/2001 Ellis ..... 482/96
6,319,178 B1 * 11/2001 Webber ..... 482/100
6,354,982 B1 * 3/2002 Sencil ..... 482/96

(Continued)

*Primary Examiner* — Rinaldi I Rada
*Assistant Examiner* — Robert F Long
(74) *Attorney, Agent, or Firm* — Coats & Bennett, P.L.L.C.

(57) ABSTRACT

A combination exercise machine comprises a movable platform assembly to perform leg presses and extended leg calf raises, a movable user support assembly which includes an adjustable brace pad assembly to perform seated isolated calf raises, a multi-function handle bar assembly, and a wrist rolling assembly to exercise the forearms.

22 Claims, 25 Drawing Sheets

U.S. PATENT DOCUMENTS 6,387,024 B1 * 5/2002 Monti et al. ..... 482/142
6,443,874 B1 * 9/2002 Bennett ..... 482/44
6,475,123 B1 * 11/2002 Evans ..... 482/97
6,558,303 B1 * 5/2003 Ellis ..... 482/138
6,561,960 B2 * 5/2003 Webber ..... 482/138
6,564,385 B2 * 5/2003 McCarthy ..... 2/16
6,605,024 B2 * 8/2003 Stearns ..... 482/142
6,659,919 B2 * 12/2003 Deola ..... 482/99
6,743,158 B2 * 6/2004 Giannelli et al. ..... 482/96
6,746,382 B2 * 6/2004 Harrison ..... 482/122
6,780,144 B2 * 8/2004 Stevens ..... 482/91
6,916,275 B2 * 7/2005 Beedy ..... 482/46
7,029,423 B2 * 4/2006 Lear, Jr. ..... 482/46
7,044,897 B2 * 5/2006 Myers et al. ..... 482/99
7,070,545 B2 * 7/2006 Lull et al. ..... 482/100
7,115,080 B2 * 10/2006 Cockrill et al. ..... 482/138
7,125,370 B1 * 10/2006 Schaffner et al. ..... 482/142
7,137,933 B2 * 11/2006 Shifferaw ..... 482/121
7,137,934 B2 * 11/2006 Paramater ..... 482/123
7,331,911 B2 * 2/2008 Webber et al. ..... 482/137
7,335,140 B2 * 2/2008 Webber et al. ..... 482/98
7,361,125 B2 * 4/2008 Webber et al. ..... 482/95
7,468,024 B2 * 12/2008 Webber et al. ..... 482/98
7,662,075 B2 * 2/2010 Isom ..... 482/97
7,670,269 B2 * 3/2010 Webber et al. ..... 482/94
7,771,322 B1 * 8/2010 Batca ..... 482/46
7,771,323 B1 * 8/2010 Batca ..... 482/46
2002/0037793 A1 * 3/2002 Eschenbach ..... 482/140
2002/0103058 A1 * 8/2002 Webber ..... 482/104
2002/0151419 A1 * 10/2002 Barnes et al. ..... 482/142
2002/0173412 A1 * 11/2002 Stearns ..... 482/123
2004/0198572 A1 * 10/2004 Rouillard ..... 482/142
2005/0032611 A1 * 2/2005 Webber et al. ..... 482/72
2005/0079957 A1 * 4/2005 Bowman et al. ..... 482/51
2005/0096196 A1 * 5/2005 Webber et al. ..... 482/94
2005/0096197 A1 * 5/2005 Webber et al. ..... 482/94
2005/0096198 A1 * 5/2005 Webber et al. ..... 482/97
2005/0130814 A1 * 6/2005 Nitta et al. ..... 482/121
2005/0143233 A1 * 6/2005 Shifferaw ..... 482/140
2006/0148625 A1 * 7/2006 Garner ..... 482/123
2006/0199707 A1 * 9/2006 Webb et al. ..... 482/94
2006/0247107 A1 * 11/2006 Carter ..... 482/99
2007/0032356 A1 * 2/2007 Rief ..... 482/130
2007/0213185 A1 * 9/2007 Habing ..... 482/100
2007/0254787 A1 * 11/2007 Matsubara et al. ..... 482/139
2007/0293377 A1 * 12/2007 Webber et al. ..... 482/94
2008/0058176 A1 * 3/2008 Webber et al. ..... 482/94
2008/0090710 A1 * 4/2008 Chung ..... 482/142
2008/0318741 A1 * 12/2008 Sencil et al. ..... 482/96
2009/0029834 A1 * 1/2009 Isom ..... 482/96

* cited by examiner

COMBINATION EXERCISE MACHINE

RELATED APPLICATIONS

This application claims priority to Provisional Patent Application No. 60/858,086 filed Nov. 10, 2006 which is incorporated herein by reference.

FIELD OF THE INVENTION

The present invention is directed generally to exercise equipment and, more particularly, a machine to perform leg presses, calf raises, forearm exercises, and pressing movements with the arms.

BACKGROUND

Various types of exercise machines for strengthening and conditioning the body are known. One type of exercise machine is a combination leg press and calf raise machine. On prior leg press and calf raise exercise machines, the user sits on a common seat, grasps two handles, outwardly stretches their legs, and places their feet on a foot platform of a moveable foot platform assembly which is generally located in front of them a little higher than the seat. The back seat is typically adjustable to accommodate different flexibility levels. To perform leg presses, the user then presses their legs outward which will cause the foot platform to move away from the user. A resistance element is connected to the moveable foot platform assembly and provides resistance to the user. (Some leg press/calf machines are the opposite wherein the foot platform is stationary and the seat moves back and forth with resistance tied to it.) This will exercise the leg and glute muscles of the user. To perform calf raises, the user lowers their feet on the same foot platform and pivots their feet at their ankles which will cause the foot platform to move away from the user. Once again, the moving foot platform provides resistance to the user. This will exercise the user's calf muscles. This will also exercise the leg and glute muscles because the users legs are in an outwardly stretched position which help support the calf muscles while exercising. This is a drawback because the user is unable isolate their calf muscles during exercise. Also, the user must place stress on their hips and knees in order to exercise their calf muscles. Thus there is a need for a combination leg press and calf raise exercise machine wherein the user could isolate their calf muscles during exercise and not place stress on their hips and knees. Also, it would be cost effective if the user could sit in the same seat while performing leg presses and isolated calf raises.

Another type of exercise machine is a pressing machine wherein the user will sit in a seat and press two exercise arms forward to exercise the chest and tricep muscles. It would be costly and require much more room to house a separate machine for performing pressing movements and a separate machine for performing leg presses and calf raises. It would be desirable to have one exercise machine that would allow a user to perform leg presses, isolated calf raises, and pressing exercises on one combination exercise machine. It would also be cost effective if the hand gripping portion on the two exercise arms could also be used as the gripping handles during leg press exercises. Also, it would be cost effective if the same seat was used for all the exercises.

Another type of exercise machine is a forearm exercising machine. One type of prior forearm exercise machine is wherein a bar is pivotally mounted on a free standing frame for a user to grasp and rotate. This bar is connected with a cable or cord to the resistance element, usually a weight stack. To exercise the forearms, the user will grasp the bar and roll their wrist forward or backward which will in turn wrap the cable or cord around the bar. The cable or cord will in turn raise the weight stack and give the user resistance. This effectively isolates and exercises the forearms, however a free standing forearm exercise machine takes up a lot of room to house and is also costly to purchase.

There is a cost effective and space efficient exercise device for exercising the forearms. It is a wrist roller which is basically a bar with a cord or rope attached in the center. On the other end of the cord or rope, the user will attach the desired amount of resistance by connecting free weights on this end. To exercise, the user will grasp the bar on the outer ends and extend their arms forward as the weights dangle below. As the user rolls their wrist forward or backward, the rope or cord wraps around the bar and lifts the weight. This does not effectively isolate the forearm muscles because the user is forced to extend their arms outward and maintain the free weights in the air as well as roll their wrist. This recruits the upper arm and shoulder muscles into the exercise. The users shoulders could fatigue before their forearms do. Thus it, would be desirable to perform isolated forearm exercises wherein the rotating bar was attached to a combination exercise machine.

Combination exercise machines are cost efficient to manufacture and space efficient because numerous stations can share the same framework and the same resistance load. Thus, there is a need for a combination exercise machine that will allow a user to perform leg presses, isolated calf exercises, pressing movements, and forearm exercises.

SUMMARY

The present invention is directed to a combination exercise gym that includes a moveable foot platform assembly to perform leg presses and extended leg calf raises, a moveable user support assembly to perform isolated seated calf exercises and chest and tricep presses, a multi-function handle bar assembly, and a wrist roller assembly for forearm exercises.

The combination exercise machine comprises a frame, multiple moveable exercise assemblies within one station, a resistance element, and a connecting assembly connecting the moveable exercise assemblies to resistance. In the exemplary embodiment, the resistance element is a weight stack and the connecting assembly is a cable assembly.

In one aspect of the invention, a user support assembly is pivotally attached to the frame. A user support assembly comprises a seat support assembly, a seat pad assembly, and a brace assembly. A brace assembly includes a brace pad assembly, which includes at least one brace pad. In one exemplary embodiment, the seat support assembly is pivotally attached to the frame. A seat pad assembly is pivotally attached to the seat support assembly to provide seating for the user during all exercises as well as multiple bottom seat angles while performing leg presses and extended leg calf raises. A brace pad assembly is pivotally attached to the seat support assembly. (In an alternate embodiment, a brace housing assembly is fixedly attached to the seat support assembly and a brace pad assembly is slidingly adjustable within the brace housing assembly.) The brace pads of the brace pad assembly can be adjusted to a lowered position below the user's legs in order to be out of the way when the user performs leg presses and extended leg calf raises. The brace pads of the brace pad assembly can be adjusted to an upper position wherein the user sits in a seated position and places the brace pads above the knees. A multi-function handle bar assembly can be pressed to lift the user support assembly which will allow the user to position their feet on foot plates mounted on the frame below. The user then pivots their feet at their ankles in an up and down motion wherein the user support assembly will then pivot up and down as well. The seat support assembly is connected to the weight stack with a cable assembly which will provide resistance to the user. This procedure will isolate the calf muscles during exercise. Pressing the multi-function handle bar at the end of exercise will lift the user support assembly and will allow the user to remove their feet off of the foot plates. When leg presses and extended leg calf raises are performed, the seat support assembly remains in a lowered and bumpered position.

In an alternate embodiment, a seat pad assembly is pivotally attached to the frame. A swing member assembly is pivotally attached to the frame. A brace pad assembly is attached to the swing member assembly. The brace pads of the brace pad assembly can be adjusted to a lowered position below the user's legs in order to be out of the way when the user performs leg presses and extended leg calf raises. The brace pads of the brace pad assembly can be adjusted to an upper position wherein the user sits in a seated position and places the brace pads above the knees. A multi-function handle bar assembly can be pressed to lift the swing member assembly which will allow the user to position their feet on foot plates mounted on the frame below. The user then pivots their feet at their ankles in an up and down motion wherein the swing member assembly will then pivot up and down as well. The swing member assembly is connected to the weight stack with a cable assembly which will provide resistance to the user. Pressing the multi-function handle bar at the end of exercise will lift the swing member assembly and will allow the user to remove their feet off of the foot plates. This procedure will isolate the calf muscles during exercise. When leg presses and extended leg calf raises are performed, the swing member assembly remains in a lowered and bumpered position.

In another aspect of the invention, a multi-function handle bar assembly is pivotally attached to the frame. In one function, the multi-function handle bar assembly lifts the user support assembly to allow the user to place their knees under the brace pads of the brace pad assembly and their feet on the frame foot plates below while the weight stack is in a raised position. In the exemplary embodiment, respective link rods are pivotally attached at one end to a respective handle bar. The other end of the link rods are pivotally attached to a wheel assembly which is pivotally attached to the frame. When the user presses the multi-function handle bar assembly forward, the link rods will rotate and pivot a wheel on the wheel assembly upward which will engage and pivot the seat support assembly upward. For isolated seated calf raises, this upward movement of the seat support assembly raises the weight stack and allows the user to position their knees below the brace pads of the brace assembly and their feet on the frame foot plates below. Because of this heightened position of the selected weight plates on the weight stack, the user can pivot their ankles upward and downward without the selected weight on the weight stack hitting the resting weight plates during exercise. A spring connected to the wheel assembly on one end and the frame on the other end will return the multi-function handle bar assembly to the start position and the wheel to a rest position on the frame while isolated seated calf raises are being performed. When the user finishes the isolated seated calf exercises, they will push the multi-function handle bar assembly forward to engage and lift the seat support assembly, remove their feet off of the frame foot plates, and lower the seat support assembly to a bumpered position.

The multi-function handle bar assembly can also be used to perform chest press and tricep exercises by pressing the handle bars forward for the desired number of repetitions. As mentioned above, the seat support assembly will pivot upward when the handle bars are pressed forward. The seat support assembly is connected to the weight stack with the cable assembly and provides resistance to the user. A back pad within a back pad assembly can be adjusted for different user sizes and flexibility levels.

The multi-function handle bar assembly can also be used for grasping by the user to give the upper body stability during leg press and extended leg calf raises. The handles will remain in a secured position because the user seat support assembly rests on a bumper as well as the wheel on the wheel assembly. This will position the wheel against the frame which will position the multi-function handle bars in the resting start position. The body weight of the user as well as the cable assembly pulling the seat support assembly into the bumpered position will keep the wheel positioned against the frame. The user will be exerting most of their force on the moving foot platform during leg press and extended leg calf raises, therefore not enough force will be exerted on the multi-function handle bars to be able to overcome the user's body weight and the cable assembly keeping the seat support assembly and the wheel of the wheel assembly in the bumpered rest position.

In another aspect of the invention, a foot platform assembly is pivotally attached to the frame. The user pushes a foot platform with their feet when performing leg presses and extended leg calf raises. In one exemplary embodiment, the foot platform assembly is connected to the weight stack with the same cable assembly that connects resistance to the user support assembly. When the user performs leg press or extended leg calf raise exercises and the foot platform is moved outward, the cable assembly displaces the weight stack to provide resistance to the user and also pulls the user support assembly to a bumpered rest position. Pulling the user support assembly to a bumpered rest position also pulls the wheel of the wheel assembly into a bumpered rest position against the frame which in turn stabilizes the handles of the multi-function handle bar assembly.

In another aspect of the invention, in one exemplary embodiment, the seat support assembly is connected to the weight stack with the same cable assembly that connects resistance to the foot platform assembly. When the user performs isolated seated calf exercises, the seat support assembly will pivot upwards which will cause the cable assembly to displace the weight stack to provide resistance to the user and to also pull the foot platform assembly to a bumpered rest position.

In another aspect of the invention, a wrist roller assembly for forearm exercises is pivotally attached to the frame. The wrist roller assembly includes a left handle and a right handle for grasping by the user. To perform forearm exercises, the user rolls their wrist forward or backward. In one exemplary embodiment, a strap wraps around the bar as it is rolled. In one exemplary embodiment, the strap is also connected to the cable assembly which is connected to the user support assembly and the moveable foot platform assembly, as well as the weight stack. When the user performs wrist rolling exercises, the strap will pull the cable assembly which will displace the weight stack and provide resistance to the user. The pulling of the strap against the cable assembly will also pull the user support assembly to a bumpered rest position as well as pull the moveable foot platform assembly to a bumpered rest position. The user is also able to share the same seat pad assembly by sitting down facing towards the wrist rolling assembly. Exercising in the seated position will allow the user to extend more of their energy towards their forearms.

The combination exercise machine can be made without some of the exercise assemblies. For example, the wrist rolling forearm exerciser could be left out. There are multiple configurations that could be made.

DETAILED DESCRIPTION

Figure 1:
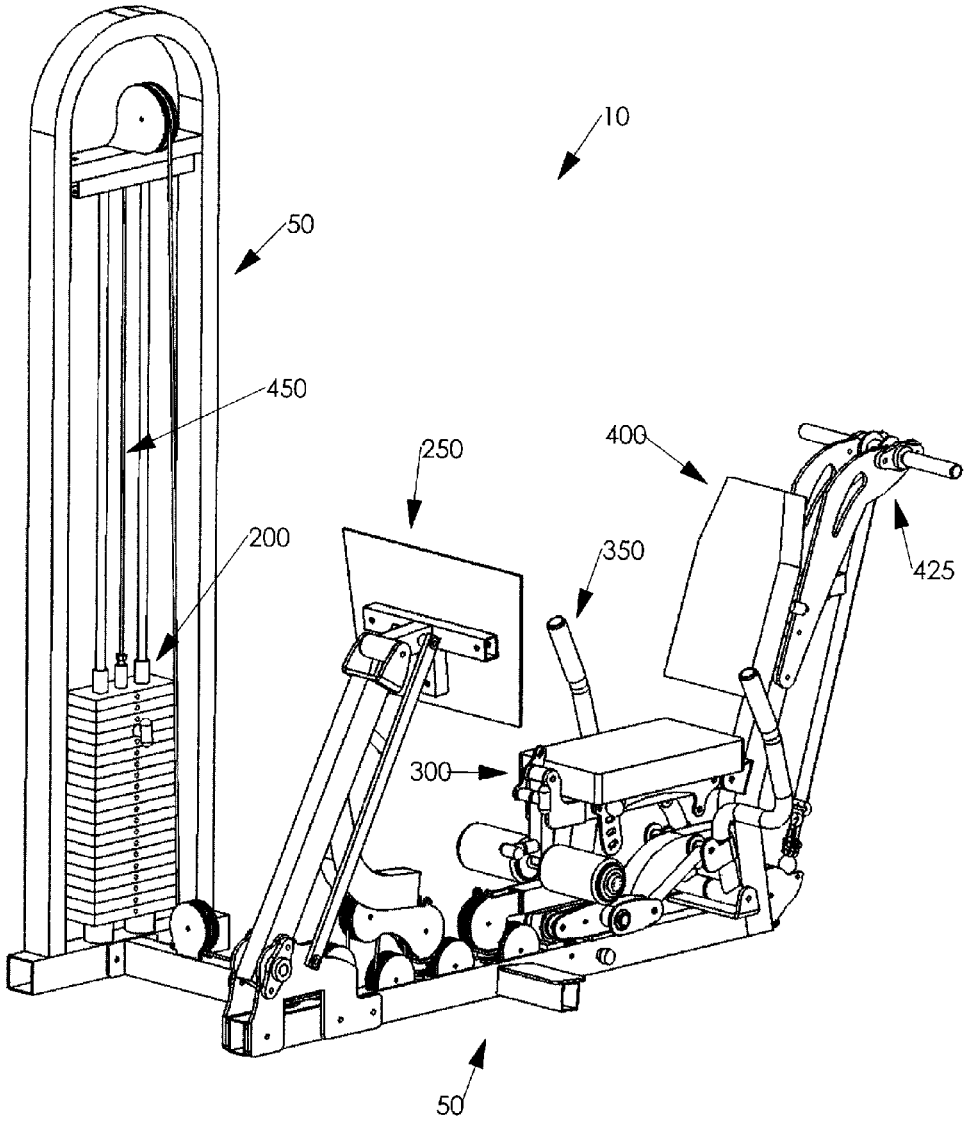
FIG. 1 is a perspective view illustrating an exemplary combination exercise machine according to the present invention from the front left side.
Figure 1:
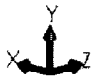
Figure 2:
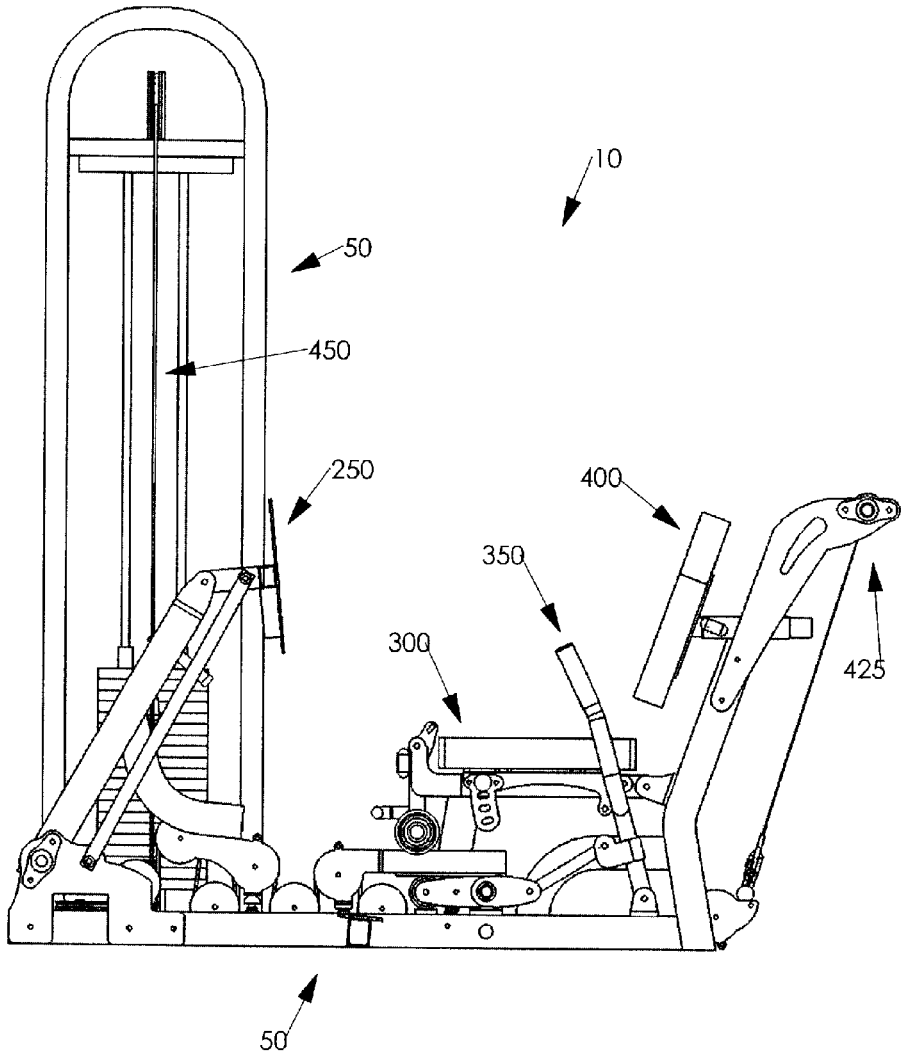
FIG. 2 is a side view illustrating an exemplary combination exercise machine according to the present invention.
Figure 2:
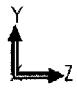

Referring now to the drawings, a combination exercise machine according to the present invention is shown therein and indicated generally by the numeral 10. As shown in FIGS. 1 and 2, the combination exercise machine 10 comprises a frame 50, weight stack or other resistance element 200, foot platform assembly 250, user support assembly 300, multi-function handle bar assembly 350, back pad assembly 400, wrist roller assembly 425, and cable assembly 450 interconnecting the foot platform assembly 250, user support assembly 300, and wrist roller assembly 425 with the weight stack 200. The exemplary embodiment shown in the drawings is for performing leg presses, extended leg calf raises, isolated calf raises, chest and tricep presses, and wrist rolling forearm exercises.

Figure 8:
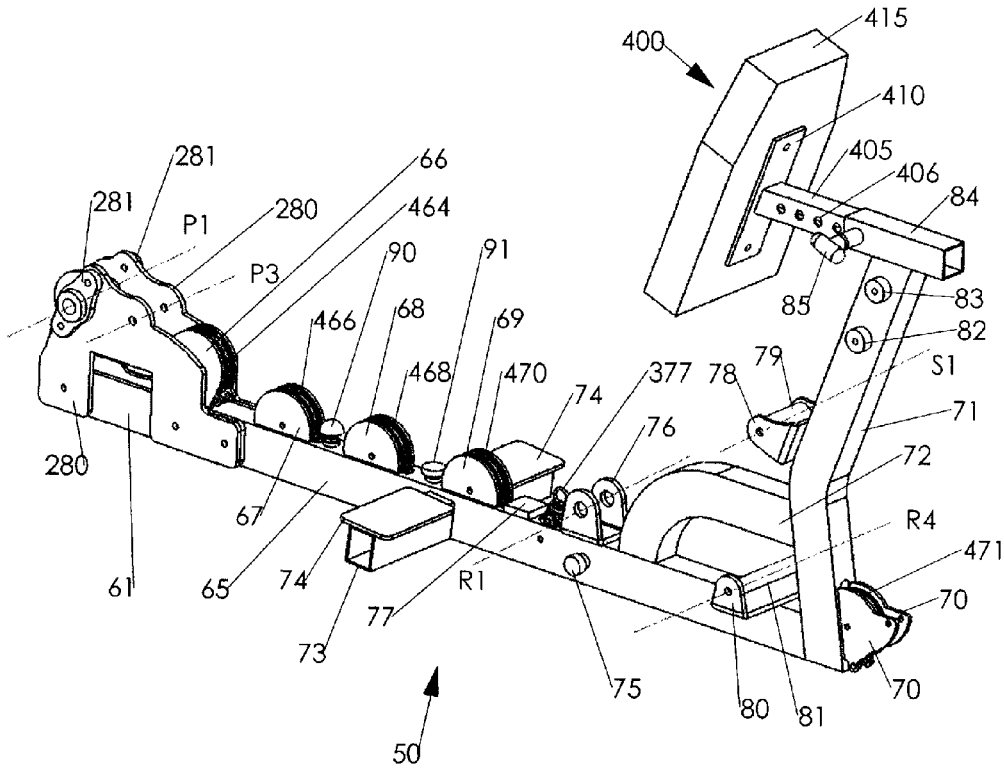
FIG. 8 is a partial view of the frame, a partial view illustrating components within the cable assembly, a partial view illustrating components within the foot platform assembly, and a back pad assembly.
Figure 8:
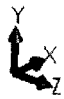
Figure 9:
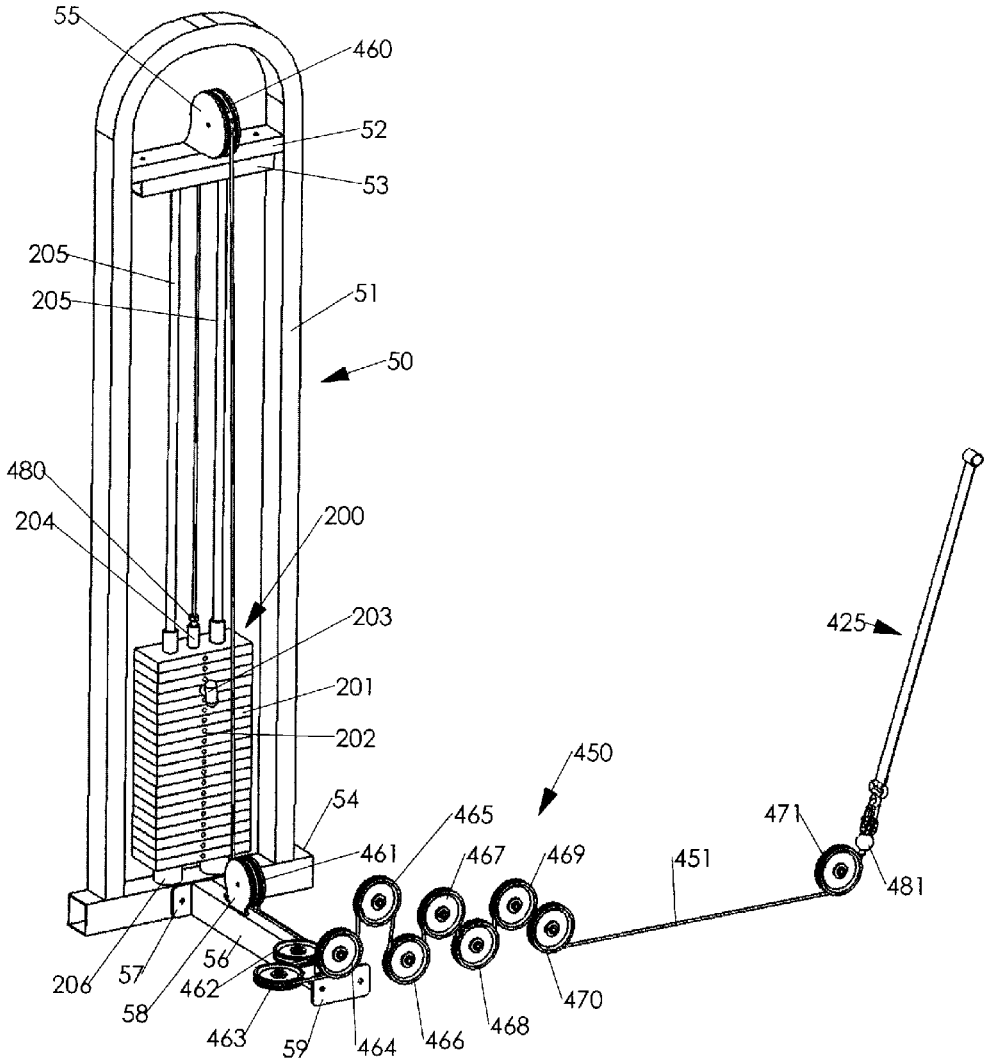
FIG. 9 is a perspective partial view of the frame and a perspective view from the front left side illustrating the exemplary cable assembly.
Figure 9:
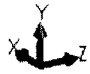

The frame 50 provides structural support and stability to the combination exercise machine 10. The frame 50 may have a variety of configurations depending upon the specific application. In one embodiment, as shown in FIGS. 8 and 9, the frame includes a weight stack cage 51 which houses the weight stack 200. Pulley plates 55 are attached to the top of cross member 52 which is attached near the top of cage 51. Guide rod support 53 is mounted underneath cross member 52 and secures the ends of guide rods 205 which guide the weight stack 200. Cage 51 is mounted on cage base 54.

Figure 4:
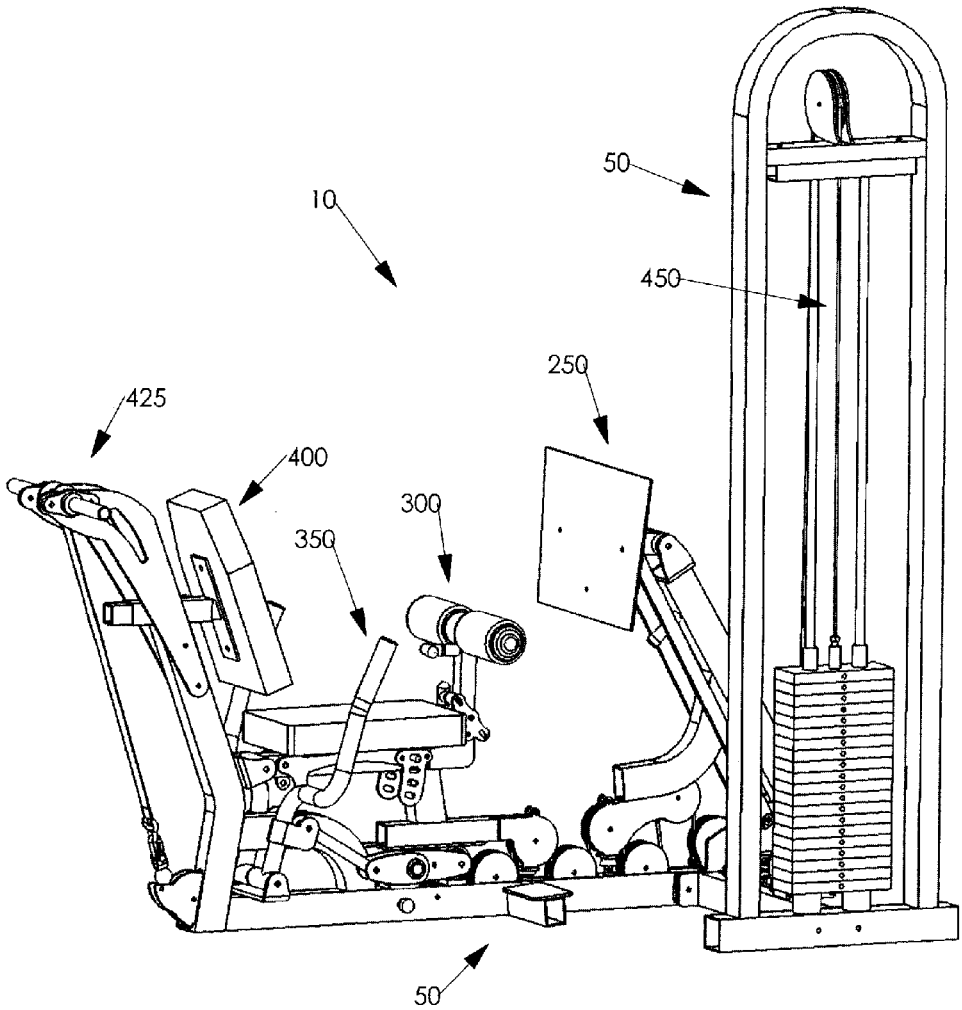
FIG. 4 is a perspective view illustrating the exemplary combination exercise machine from the back right side wherein the brace pads of the brace assembly is adjusted in an upward position for bracing the users legs while performing isolated seated calf exercises.
Figure 4:
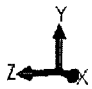
Figure 7:
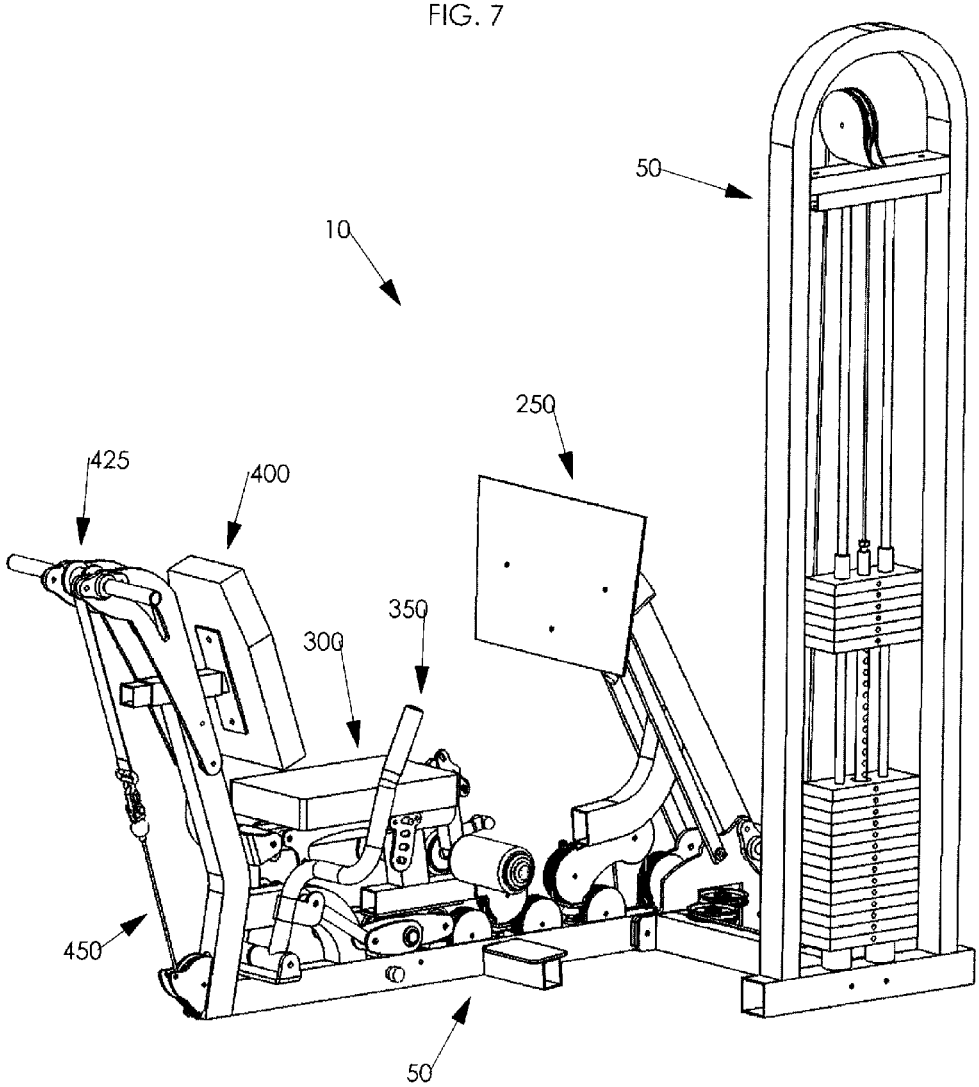
FIG. 7 is a perspective view illustrating the exemplary combination exercise machine from the back right side wherein the wrist roller assembly is rolled upward and the resistance element is displaced.
Figure 7:
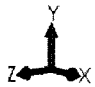
Figure 10:
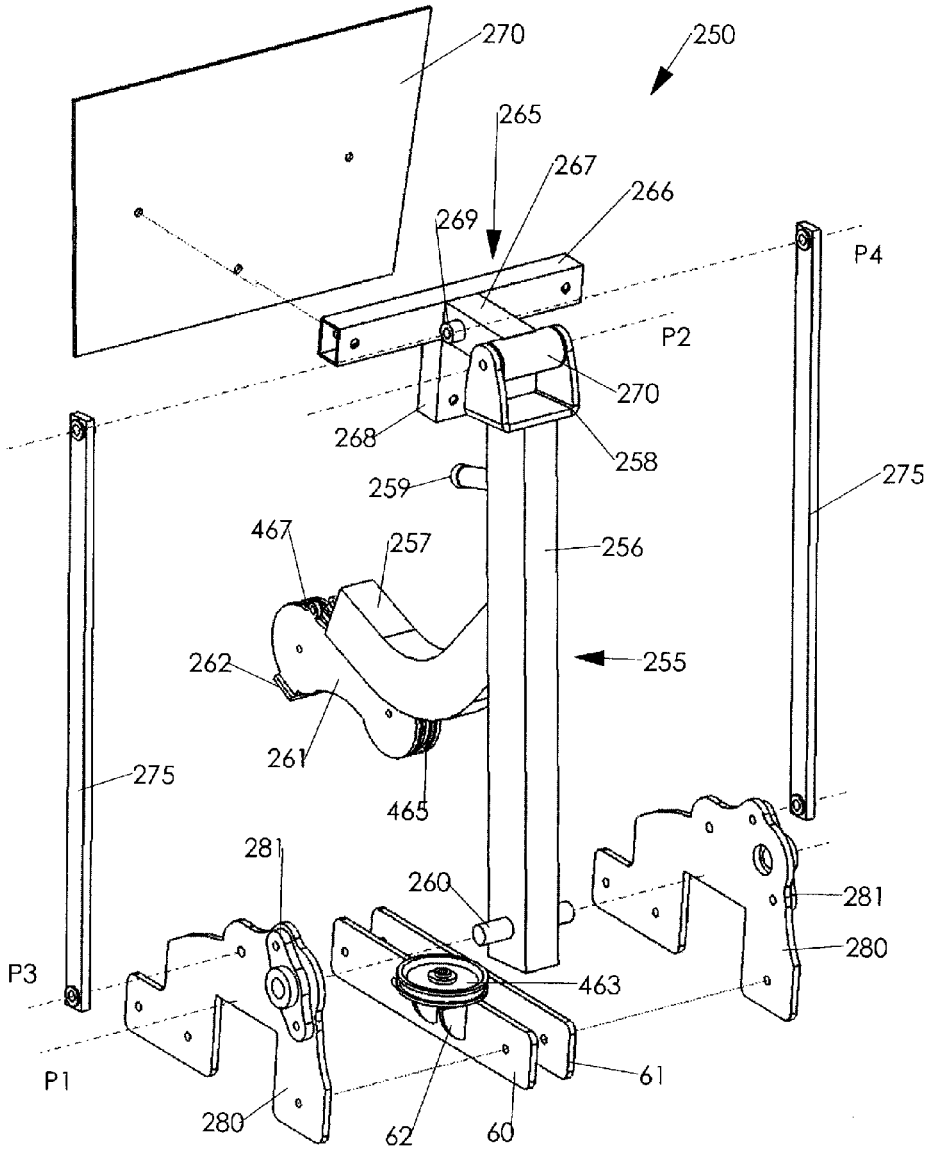
FIG. 10 is an exploded perspective view illustrating the foot platform assembly.

The frame 50 further includes connector base 56 which has a connection plate 57 attached at one end and a connection plate 59 attached at the other end. Connection plate 57 is attached to cage bottom 54 and connection plate 59 is attached to main base 65 as shown in FIG. 4. As shown in FIGS. 7 and 10, connection plate 280 of the foot platform assembly 250 and spacer plate 60 is positioned in between connection plate 59 and main base 65. Bracket 62 is attached to spacer plate 60 and provides a mounting point for pulley 463 of the cable assembly 450. Spacer plate 61 is mounted on the opposite side of main base 65 in line with spacer plate 60.

The frame 50 further includes foot plate tubes 73 attached to respective sides of main base 65. Respective foot plates 74 are mounted on top of respective foot plate tubes 73 and provide a foot brace for the user's feet during isolated calf exercises. Back brace 71 is attached at the end of main base 65 and provides attachment points for the user support assembly 300, the back pad assembly 400, pulley 471, and wrist rolling assembly 425. Brace 72 supports the back brace 71 with the main base 65. Bracket 78 contains axle 79, which is labeled with an axis of rotation S1, and is attached to the front side of back brace 71 and provides a pivot point for the user support assembly 300. Locking pin 85 is attached to sleeve 84 which is attached to the top of back brace 71 and provides housing for the back pad assembly 400. Pulley plates 70 are attached near the bottom and back of back brace 71 and provide housing for pulley 471. Spacers 82 and 83 are attached near the top of back brace 71 and is where the wrist rolling assembly 425 is attached.

The frame 50 further includes bracket 80 which is attached to the top of main base 65 near the back brace 71. Axle 81 is contained in bracket 80, is labeled with an axis of rotation R4, and provides a pivot point for the multi-function handle bar assembly 350. Bracket 76 contains axle 375 (shown in FIG. 12), which is labeled with an axis of rotation R1, and is attached to the top of main brace 65 and provides a pivot point for the wheel assembly 365 (shown in FIG. 12). Wheel plate 77 is attached near the middle on top of main brace 65 and provides a rest position for wheel 378 of the wheel assembly 365. Bumpers 75 are attached below bracket 76 to respective sides of main base 65 and provide a pivoting end point for the multi-function handle bar assembly 350.

The frame 50 further includes bumper 91 which is attached near the middle on top of main base 65 and provides a pivoting end point and rest position for the user support assembly 300. Bumper 90 is attached near bumper 91 on top of main base 65 and provides a pivoting end point and rest position for the foot platform assembly 250. Pulley plates 66, 67, 68, and 69 are attached on top of main base 65 and provide attachment points for respective pulleys 464, 466, 468, and 470 of the cable assembly 450.

The weight stack 200 provides resistance to the force applied by the user to the foot platform assembly 250, the user support assembly 300, and the wrist roller assembly 425. In the exemplary embodiment, the weight stack 200 shown in FIG. 9 includes a number of individual weight plates 201 that can be selectively added to and removed from the load picked-up by the user to provide variable amounts of resistance. Guide rods 205 extend through apertures in each of the plates 201. The bottom end of the guide rods 205 are secured to the cage bottom 54. The top ends of the guide rods 205 are secured to guide rod support 53. The plates 201 slide vertically along the guide rods 205 as the user exercises. A lifting rod 204 includes a series of apertures that align with corresponding apertures 202 in the weight plates 201. The user selects the desired number of plates 201 to be lifted by inserting a pin 203 through the aperture 202 in a selected plate 201 and engages the pin 203 with the aperture in the lifting rod 204. Those skilled in the art will appreciate that other resistance devices, such as electronic resistance devices, magnetic breaks, hydraulic cylinders, elastic bands, or pneumatic resistance may also be used to practice the present invention.

Figure 3:
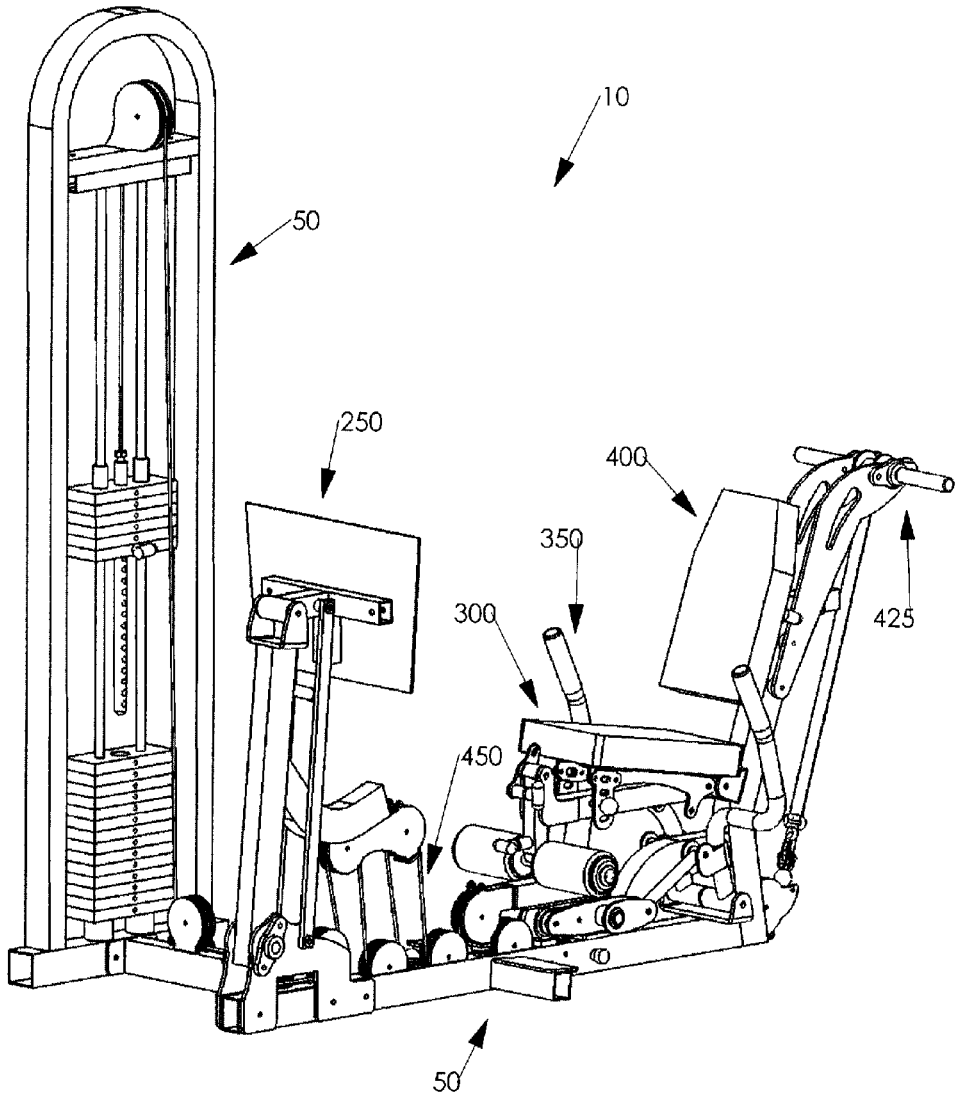
FIG. 3 is a perspective view illustrating an exemplary combination exercise machine with the foot platform assembly moved to an outward position, the brace assembly stored in a lowered position, and the seat pad assembly angled upward.
Figure 3:
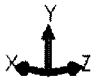

The foot platform assembly 250, illustrated in FIG. 10, comprises a foot platform 270 that is pushed by the user when performing leg presses and extended leg calf raises. The foot platform assembly 250 is connected to the weight stack 200 with cable assembly 450 which provides resistance to the user when the foot platform 270 is pushed. FIG. 3 illustrates combination exercise machine 10 wherein foot platform assembly 250 is pushed to an outer position and the selected weights are lifted by cable assembly 450.

In the exemplary embodiment, illustrated in FIG. 10, the foot platform assembly 250 includes main arm assembly 255 and platform swivel assembly 265. Main arm assembly 255 comprises main arm 256 which has axle 260 attached near the bottom end. Axle 260 is labeled with an axis of rotation P1 and attaches at both ends to respective bearings 281. Bearings 281 are attached to respective connection plates 280 which are attached to the outsides of spacer plates 60 and 61. Spacer plates 60 and 61 are attached to the main base 65 which secures the foot platform assembly 250 to the frame 50. Extension tube 257 is attached near the middle on the back side of main arm 256. Pulley plates 261 are attached underneath the extension tube 257 at the other end and provide attachment points for pulleys 465 and 467 of the cable assembly 450. Bumper plate 262 is attached to the bottom side of pulley plates 261 and bumpers against bumper 90 on the main base 65 to provide the foot platform assembly 250 a rest position. Bumper 259 is attached on the back side near the top of main arm 256 and bumpers against platform 270 to provide a pivoting end point for the foot platform assembly 250. Bracket 258 is attached to the top of main arm 256 and provides a pivoting attachment point for the platform swivel assembly 265 with an axis of rotation labeled P2.

The platform swivel assembly 265 comprises platform support 266 which provides a mounting point for platform 270. Extension tube 268 is attached underneath platform support 266 and provides extra support for platform 270. Connector tube 267 is attached to the middle front side of platform support 266 at one end and to bushing tube 270 at the other end. Bushing tube 270 is pivotally attached to bracket 258 and is rotatable about axis P2. Bar tube 269 is attached through the side of connector tube 267 and is labeled with an axis of rotation P4. Respective limit bars 275 are attached to the outsides of bar tube 269 at one end and are rotatable about axis P4. The other end of limit bars 275 are attached to the outsides of respective connection plates 280 with a connection axis labeled P3.

In use, the user places their feet on the platform 270 and presses outward. The main arm assembly 255, the platform swivel assembly 265, and the two limit bars 275 will rotate about axes P1, P2, P3, and P4 to align the users feet wherein the feet will maintain full contact on the platform 270 while performing leg presses throughout the entire range of motion. This four point rotation of foot platform 270 will also aid in the comfort of the user while performing extended leg calf raises when the user pivots their ankles back and forth. Pulleys 465 and 467 will pull cable assembly 450 which will raise the weight stack 200 and provide resistance to the user.

Figure 5:
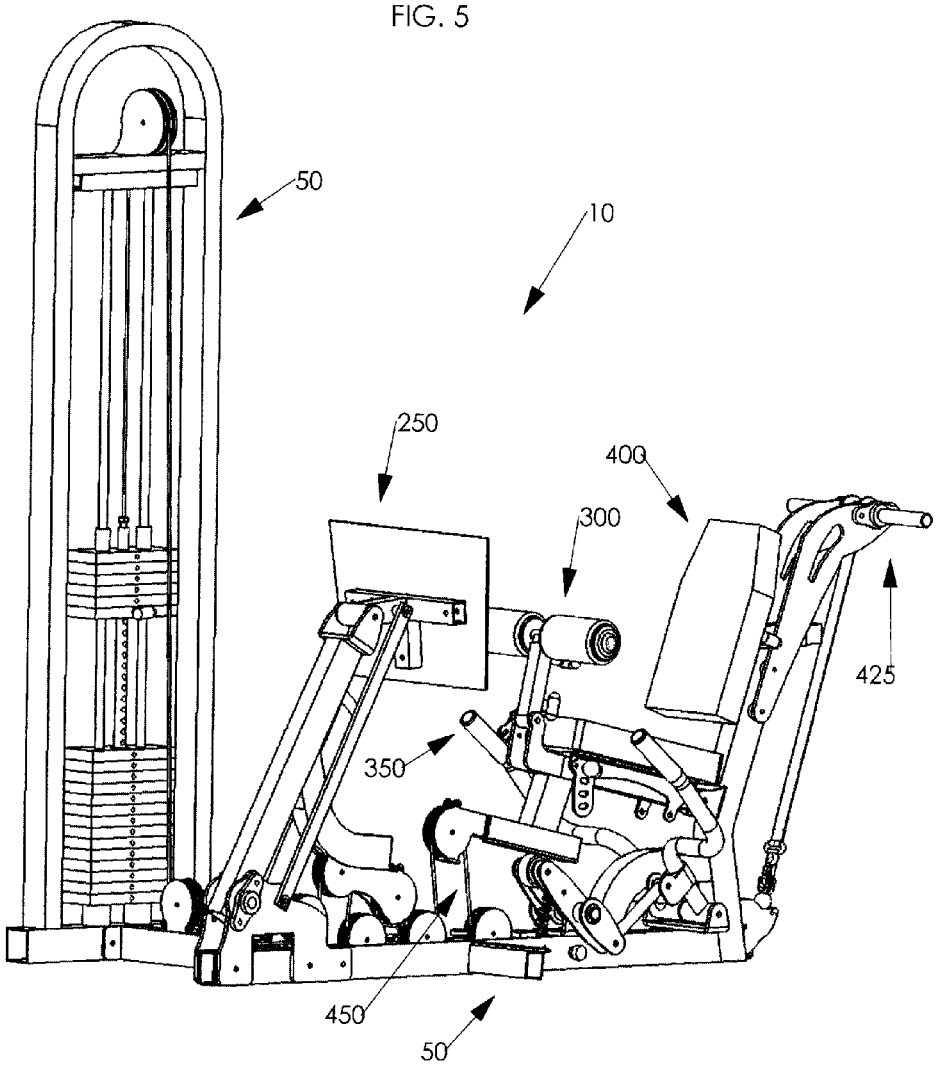
FIG. 5 is a perspective view illustrating the exemplary combination exercise machine from the front right side wherein the user support assembly is raised to an upward position and the brace pads of the brace assembly is adjusted in an upward position for bracing the users legs while performing isolated seated calf exercises.
Figure 5:
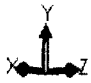
Figure 11:
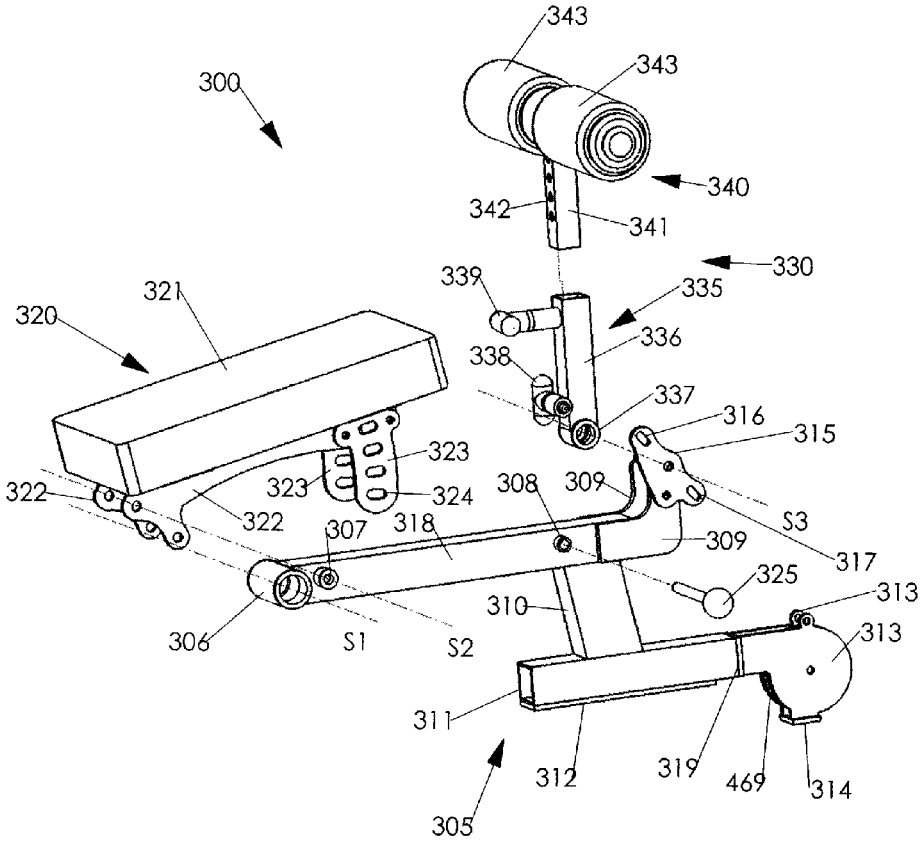
FIG. 11 is an exploded perspective view illustrating the user support assembly.
Figure 11:
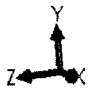

The user support assembly 300, illustrated in FIG. 11, provides seating for the user while performing leg presses, extended leg calf raises, isolated calf raises, chest and tricep presses, and wrist rolling forearm exercises. The user support assembly 300 also comprises an adjustable brace assembly 330 for performing isolated seated calf exercises. The brace assembly 330 includes brace pads 343 which are adjustable to an upward position above the user's legs for performing isolated seated calf exercises and adjustable to a lowered position below the user's legs while performing leg presses and extended leg calf raises. The user support assembly 300 is pivotally attached to frame 50 and connected to weight stack 200 with cable assembly 450 which provides resistance to the user when the seat support assembly 305 is moved. FIG. 3 illustrates combination exercise machine 10 wherein the brace pads 343 of the brace assembly 330 are adjusted to a lowered position out of the way when leg press or extended leg calf raises are performed. FIG. 5 illustrates combination exercise machine 10 wherein the brace pads 343 of the brace assembly 330 are adjusted to an upward position for performing isolated seat calf exercises wherein the brace pads 343 of the brace assembly 330 would brace the user's leg's above the knees while in a seated position.

In the exemplary embodiment, illustrated in FIG. 11, the user support assembly 300 includes seat support assembly 305, seat pad assembly 320, and brace assembly 330. Seat support assembly 305 comprises seat tube 318 wherein bushing tube 306 is attached at one end and respective end plates 309 are attached at the other end. Bushing tube 306 is labeled with an axis of rotation S1 and is where the user support assembly 300 is pivotally mounted to bracket 78 of frame 50. Adjustment plate 315 is attached to the right end plate 309 and provides adjustment locking points for the brace assembly 330. Adjustment plate 315 along with end plates 309 have an aperture formed therein labeled with an axis of rotation S3 wherein the brace assembly 330 is pivotally attached and rotatable about axis S3. Pin tube 308 is attached through the side of seat tube 318 near the end plates 315 and provides housing for seat pin 325. Bushing tube 307 is attached through the side of seat tube 318 near bushing tube 306 and is labeled with an axis of rotation S2 and provides an attachment point for seat pad assembly 320. Extension tube 310 at one end is attached underneath seat tube 318 and attached on top of wheel tube 311 at the other end. Wheel plate 312 is attached underneath wheel tube 311 and provides a track for wheel 378 (shown on FIG. 12) to travel on when the multi-function handle bar assembly 350 engages and lifts the seat support assembly 305. End cap 319 is attached at one end of wheel tube 311. Pulley plates 313 are attached to end cap 319 and provide an attachment point for pulley 469 of the cable assembly 450. Bumper plate 314 is attached underneath pulley plates 313 and bumpers against bumper 91 on the main base 65 to provide the user support assembly 300 a rest position.

Seat pad assembly 320 comprises seat pad 321 for the user to sit on while performing exercise. Brackets 322 are attached underneath seat pad 321 and have adjustment plates 323 attached at one end. The seat pad assembly is pivotally attached to the seat support assembly 305 and rotatable about axis S2. Seat pin 325 fits through the selected apertures 324 of the adjustment plates 323 and rests inside of pin tube 308 to provide the user with the desired seat pad assembly 320 angle. Those skilled in the art will appreciate that seat pad 321 could be fixedly attached to seat support assembly 305 to carry out the present invention.

Brace assembly 330 comprises a brace housing assembly 335 and a brace pad assembly 340. Brace housing assembly 335 comprises sleeve 336 wherein the brace pad assembly 340 is slidingly adjustable. Bushing tube 337 is attached at the bottom of sleeve 336 and is pivotally attached to the seat support assembly 305 and is rotatable about axis S3. Locking pin 338 is attached near the bottom of sleeve 336 and engages the aperture 316 of the adjustment plate 315 to lock the brace assembly 330 into an upward position. Locking pin 338 engages the aperture 317 of the adjustment plate 315 to lock the brace assembly 330 into a downward position. Locking pin 339 is attached near the top of sleeve 336 and engages the selected apertures 342 of the brace pad assembly 340. Those skilled in the art would appreciate that the brace assembly 330 could be used in an upward position or a downward position without being locked into those positions to carry out the present invention.

Brace pad assembly 340 comprises adjustment tube 341 which has apertures 342 formed therein. Brace pads 343 are attached at one end of the adjustment tube 341 wherein the other end is slidingly adjustable inside of brace housing assembly 335 and can be locked into position with locking pin 339 according to the size and flexibility of the user. Those skilled in the art would appreciate that brace pads 43 could be fixedly attached to the brace housing assembly 335 and not be length adjustable in order to carry out the present invention.

Figure 14:
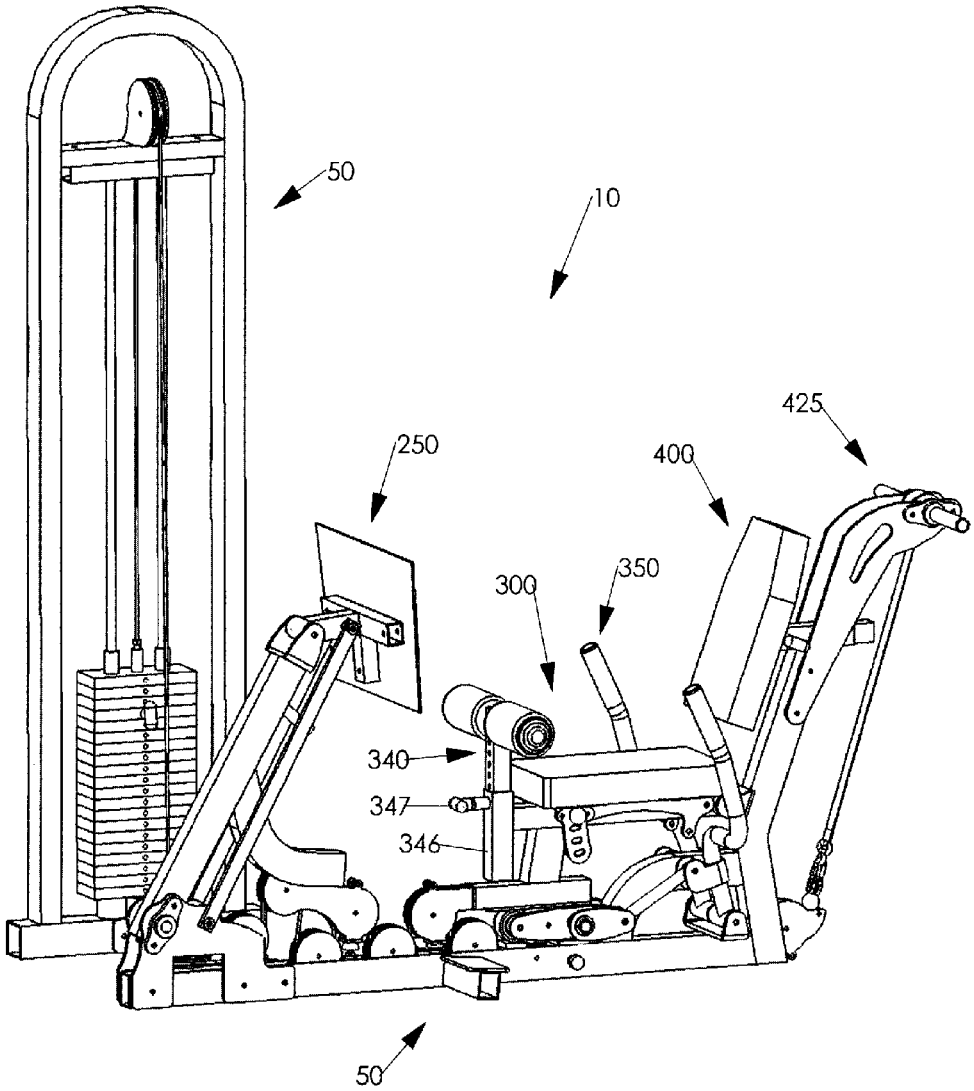
FIG. 14 is a perspective view illustrating a combination exercise machine from the front left side wherein an alternate embodiment of the brace assembly is attached to the seat support assembly.
Figure 14:
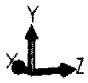

FIG. 14 illustrates an alternate brace assembly 300 wherein a sleeve 346 and a locking pin 347 are fixedly attached to the seat support assembly 305. A brace pad assembly 340 is slidingly adjustable into sleeve 346 and can be adjusted to a lowered position when performing leg presses and extended leg calf raises or to an upward position when performing isolated seated calf exercises.

In use, the user will sit on the user support assembly 300 to perform exercise on the combination exercise machine 10. To perform leg presses and extended leg calf raises, the user will adjust the seat pad assembly 320 to the desired angle by removing seat pin 325 out of pin housing 308, rotating the seat pad assembly 320 to the desired angle, and by re-engaging the seat pin 325 into the selected apertures 324 in adjustment plates 323 and the pin housing 308. The user then adjusts the brace pads 343 of the brace assembly 330 to a lowered position to be out of the way. The user then grasps the multi-function handle bar assembly 350 to stabilize their upper body. The user then presses the foot platform assembly 250 for the desired number of repetitions. The user's body weight while seated on the user support assembly 300 along with cable assembly 450 being connected to the seat support assembly 305 and pulling the seat support assembly 305 downward to a bumpered rest position will keep the user support assembly 300 in a bumpered and rest position while leg presses and extended leg calf raises are being performed.

To perform isolated seated calf exercises, the user will sit on the seat pad assembly 320 facing forward and adjust the brace pads 343 of the brace pad assembly 330 to an upward position above their knees. The user will then press the multi-function handle bar assembly 350 forward which will raise the user support assembly 300 upward as well as raise the selected weights 201 in weight stack 200. The user then places their feet on the frame foot plates 74 below. The user will then let the multi-function handle bar assembly 350 return to a bumpered rest position. As the users legs above the knees are braced by the brace pads 343 of the brace assembly 330, they will pivot their feet at their ankles for the desired number of repetitions. This will raise and lower the user support assembly 300 which is connected to the weight stack 200 and provide resistance to the user. When finished performing isolated seated calf exercises, the user will press the multi-function handle bar assembly 350 forward to re-engage and lift the seat support assembly 305 which will lift the user support assembly 300 upward. This will lift the brace pads 343 of the brace pad assembly 330 off of the user's legs above the knees and allow the user to remove their feet off of the frame foot plates 74. The user will then return the multi-function bar assembly 350 back to a bumpered rest position.

Figure 6:
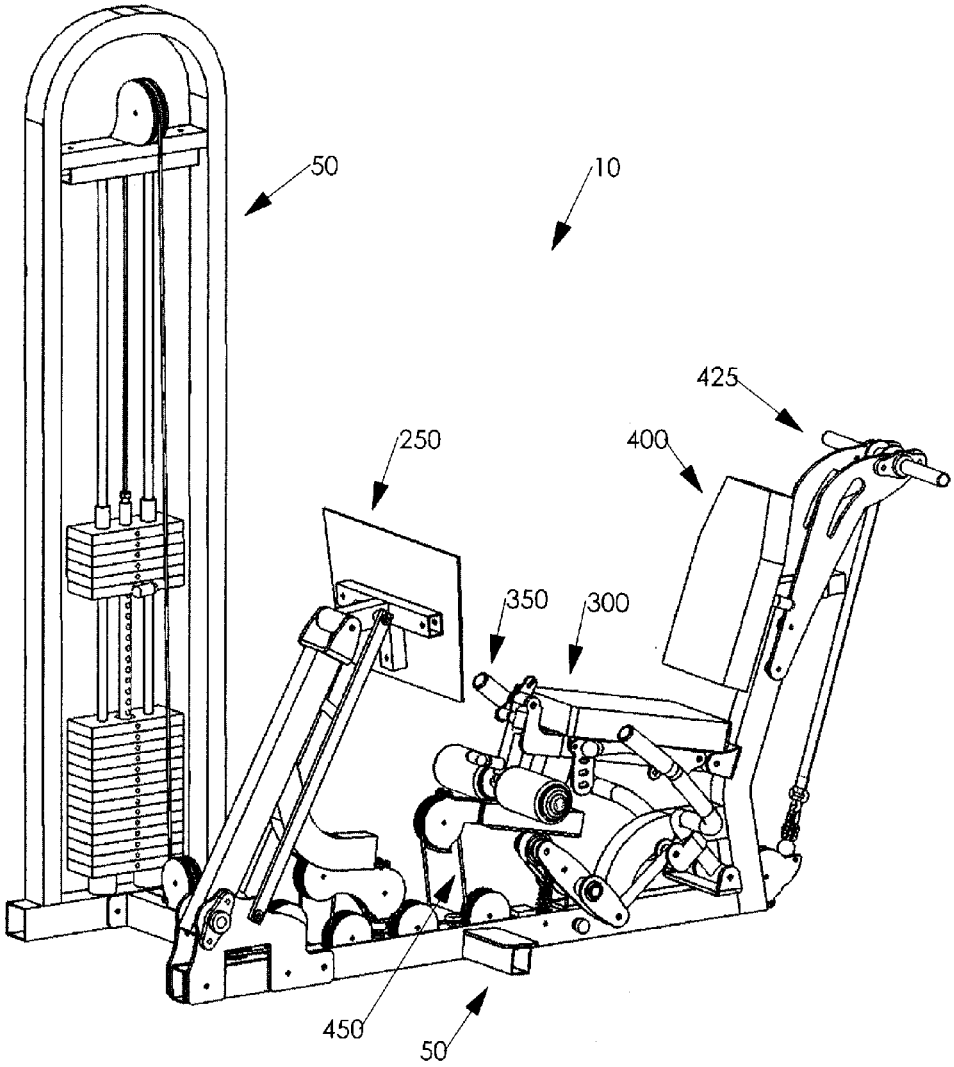
FIG. 6 is a perspective view illustrating the exemplary combination exercise machine from the front right side wherein the brace pads of the brace assembly is adjusted in a lowered stored position and the multi-function handle bar assembly is positioned forward at an outer end position of pressing exercises.
Figure 6:
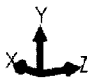

To perform chest and tricep presses, the user will sit on the seat pad assembly 320 facing forward. The user can adjust the brace pads 343 of the brace assembly 330 upward if they would like there legs braced on top while pressing or they can adjust the brace pads 343 of the brace assembly 330 downward to a storage position out of the way while pressing. The user will then press the multi-function handle bar assembly 350 forward which will raise the user support assembly 300 upward as wheel 378 of the wheel assembly 365 engages and travels along wheel plate 312 of the seat support assembly 305. Since the cable assembly 450 is connected to the seat support assembly 305, the selected weight plates 201 of the weight stack 200 will lift and provide resistance to the user as the user support assembly 300 rotates about axis S1. FIG. 6 illustrates a combination exercise machine 10 wherein the multi-function handle bar assembly 350 is in a pressed position and the user support assembly 300 is in a raised position as a result of wheel 378 engaging and traveling along wheel plate 312 of the seat support assembly 305. The brace pads 343 of the brace assembly 330 are adjusted to a lowered position.

To perform wrist rolling forearm exercises, the user will sit on the seat pad assembly 320 facing backward and grasp the handle bar 427 (shown in FIG. 13) of the wrist rolling assembly 425. The user will then roll their wrist forward or backward which will pull cable assembly 450 as strap 442 (shown in FIG. 13) wraps around handle bar 427 to provide resistance to the user. Those skilled in the art would appreciate that wrist rolling forearm exercises could be performed while the user is in a standing position or sitting in a chair or other type seat opposite of the seat pad assembly 320 on the combination exercise machine 10.

Figure 12:
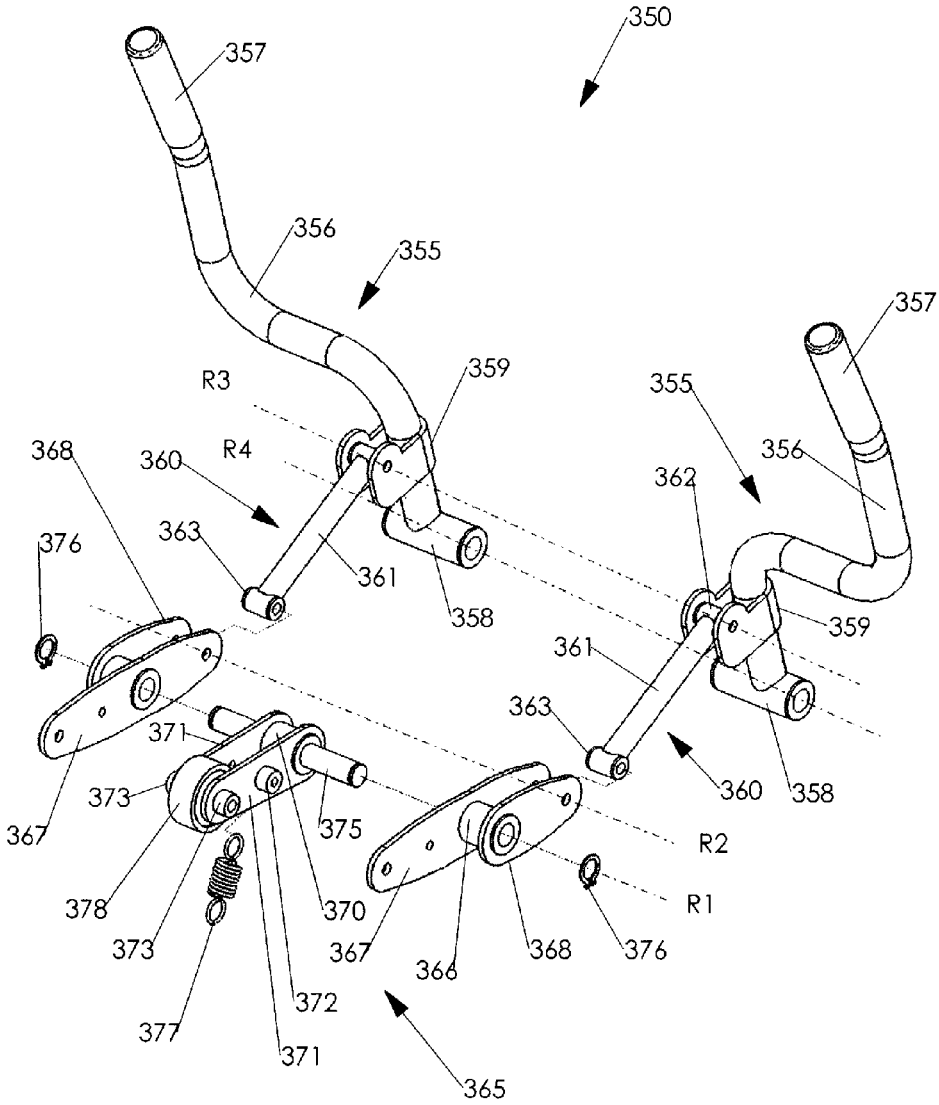
FIG. 12 is an exploded perspective view illustrating the multi-function handle bar assembly.

The multi-function handle bar assembly 350, illustrated in FIG. 12, provides means to lift the user support assembly 300 upward to enable the user to position their feet on and off of the frame foot plates 74 in the beginning and end of seated isolated calf exercises. The multi-function handle bar assembly 350 also includes handle bar assemblies 355 that can be pressed in order to provide the user with chest and tricep exercises. The multi-function handle bar assembly 350 also provides handle bar assemblies 357 for grasping by the user to stabilize the upper body while performing leg presses and extended leg calf raises.

In the exemplary embodiment, illustrated in FIG. 12, the multi-function handle bar assembly 350 includes respective handle bar assemblies 355, respective link rod assemblies 360, and wheel assembly 365. A respective handle bar assembly 355 comprises handle bar 356 wherein grip 357 is attached at the upper end for gripping by the user and bushing tube 358 is attached at the lower end and labeled with an axis of rotation R4. Bushing tube 358 is pivotally attached to bracket 80 of frame 50 and is rotatable about axis R4. Bracket 359 is attached near the lower end of handle bar 356 and contains an aperture that is labeled with an axis of rotation R3 wherein one end of link rod assembly 360 is pivotally attached.

A respective link rod assembly 360 comprises link rod 361 wherein bushing tube 362 is attached on one end and bushing tube 363 is attached on the other end. Bushing tube 362 is pivotally attached to bracket 359 of the handle bar assembly 355 and is rotatable about axis R3.

The wheel assembly 365 comprises shaft 375 which is labeled with an axis of rotation R1. Shaft 375 is pivotally attached to bracket 76 of frame 50 and is rotatable about axis R1. Bushing tube 370 has an outer wheel plate 371 attached to each end and is slidingly mounted onto shaft 375. Wheel 378 is attached near one end of outer wheel plates 371. Spacers 372 and 373 are attached to the outsides of outer wheel plates 371. Spring 377 is attached in between in the center of outer wheel plates 371. Respective bushing tubes 366 have a respective inner link plate 367 attached to the inside end and a respective outside link plate attached to the outside end. Bushing tubes 366 slidingly mount over respective ends of shaft 375. Inner link plates 367 and outer link plates 368 have a respective aperture formed therein near one end and is labeled with axis of rotation R2. Bushing tubes 363 of the link rod assemblies 360 are pivotally attached to respective inner link plates 367 and outer link plates 368 and are rotatable about axes R2. Respective snap rings 376 attach to shaft 375 and secure the entire wheel assembly 365 onto bracket 76 of frame 50.

To perform seated isolated calf raises, the user will brace their legs above their knees with the brace pads 343 of the brace pad assembly 340. The user will then press the multi-function handle bar assembly 350 forward to lift the user support assembly 300 upward to enable the user to position their feet on and off of the frame foot plates 74 in the beginning and end of seated isolated calf exercises. The handle bar assemblies 355 rotate about axis R4 when they are pressed forward. Link rod assemblies 360 rotate about axes R2 and R3 and press the wheel assembly 365 downward on one end and upward on the other end wherein wheel 378 is lifted upward. The wheel assembly 365 is rotating on axis R1. As wheel 378 is lifted, it engages the seat support assembly 305 and travels along wheel plate 312 as the multi-function handle bar assembly is being pressed. This will lift the user support assembly 300 upward and provide resistance to the user since cable assembly 450 connects the seat support assembly to the weight stack 200. While performing seating isolated calf raises, the user will release the multi-function handle bar assembly 350 wherein spring 377 will pull wheel 378 into a bumpered position against wheel plate 77 on frame 50. This will return the multi-function handle bar assembly 350 to the start position while the user is performing seating isolated calf raises. Those skilled in the art will appreciate that there are a variety of configurations of linkages that could be used in order to lift the user support assembly 300.

As previously described the multi-function handle bar assembly can be used for chest and tricep presses and the above paragraph describes the mechanics of the multi-function handle bar assembly 350.

The multi-function handle bar assembly 350 can also be used for grasping by the user to give the upper body stability during leg press and extended leg calf raises. In use, the user sits on seat pad assembly 320 and grasps handle bars 356 then presses the foot platform assembly 250 for the desired number of repetitions. The handle bars 356 will remain in a secured position because the user seat support assembly 300 rests on a bumper 91 as well as the wheel 378 on the wheel assembly 365. This will position the wheel 378 against wheel plate 77 on the frame 50 which will position the multi-function handle bar assembly 350 in the resting start position. The body weight of the user sitting on seat pad assembly 320 as well as the cable assembly 450 pulling the seat support assembly 305 into the bumpered position will keep the wheel 378 positioned against the frame 50. The user will be exerting most of their force on the moving foot platform assembly 250 during leg press and extended leg calf raises, therefore not enough force will be exerted on the multi-function handle bar assembly 350 to be able to overcome the user's body weight and the cable assembly 450 keeping the seat support assembly 305 and wheel 378 of the wheel assembly 365 in the bumpered rest position.

The back pad assembly 400 is illustrated in FIG. 8. The back pad assembly 400 is adjustably attached to sleeve 84 on frame 50 and provides back seat support for the user while performing leg presses, seating isolated calf raises, chest presses, and tricep presses. The back pad assembly comprises seat pad 415 which is attached to seat plate 410 which is attached to adjustment tube 405. Adjustment tube 405 has apertures 406 formed therein. In use, the user will adjust the back pad assembly 400 by unlocking locking pin 85, sliding the back pad assembly 400 to the desired position based on user size and flexibility, and by relocking locking pin 85 into the desired aperture 406.

Figure 13:
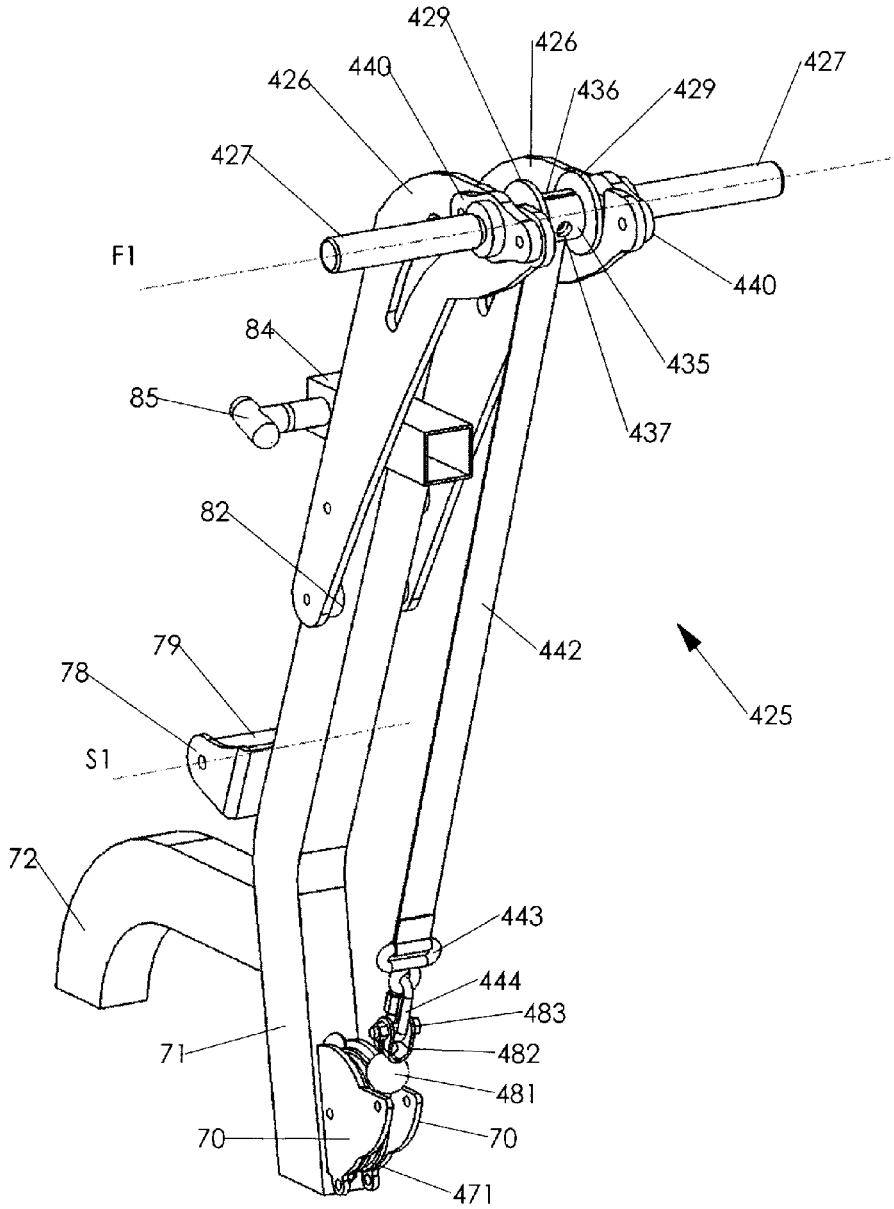
FIG. 13 is a perspective partial view of the frame and a perspective view from the back left side illustrating the exemplary wrist rolling forearm exercise assembly.
Figure 13:
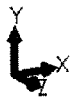

The wrist rolling assembly 425 is illustrated in FIG. 13. The wrist rolling assembly 425 provides the user with means to perform isolated forearm exercises. The wrist rolling assembly 425 comprises respective connection plates 426 which are attached to respective sides of back brace 71 of frame 50. Respective spacers 82 and 83 (shown in FIG. 8) are mounted in between respective connection plates 426 and the back brace 71. Respective bearings 440 are mounted near the top of respective connection plates 426 wherein roller bar 427 is rotatably mounted through the bearings 440 with an axis of rotation labeled F1. One end of strap 442 is connected to handle bar 427 wherein the end of strap 442 is secured to the handle bar 427 in a clamping fashion by round clamp plates 435 and 436. A bolt (not shown) goes through countersunk holes 437 of the round clamp plates 435 and 436 to secure the strap 442 to handle bar 427. Respective side plates 429 retain the strap 442 to align the strap 442 as the strap 442 is rolled upward during exercise. Buckle 443 is attached to the other end of strap 442 and is connected to strap 482 of cable assembly 450 by hook 444 and bolt 483.

In use, the user will sit in seat pad assembly 320 facing toward the wrist roller assembly 425 and will grasp handle bar 427. The user may also choose to stand or sit in some other chair or bench. The user will then roll their wrist forward or backward wherein the strap 442 will begin to wrap around round clamp plates 435 and 436. This will pull cable assembly 450 and lift the selected weight plates 201 of weight stack 200 wherein resistance will be provided to the user. This will isolate the forearm muscles of the user. FIG. 7 illustrates a combination exercise machine 10 wherein strap 442 is rolled upward wherein cable assembly 450 is also pulled upward and the selected weight plates 201 of weight stack 200 are lifted. Those skilled in the art will appreciate that a cable, belt, rope, cord, or some other connecting member could be used to carry out the present invention rather than a strap. Also, cable assembly 450 could be made to directly tie into handle bar 427.

The connecting assembly 450 is illustrated in FIGS. 8 and 9. In the exemplary embodiment, the connecting assembly 450 is a cable assembly. Cable assembly 450 connects the foot platform assembly 250, the user support assembly 300, and the wrist rolling assembly 425 to resistance. Cable assembly 450 comprises cable 451 which at one end is connected to weight stack 200 with bolt 480. Cable 450 then travels upward and wraps around fixed pulley 460 then travels downward and wraps around fixed pulley 461. Cable 451 then wraps around fixed pulleys 462, 463, and 464. Cable 451 then wraps around moveable pulley 465 of the foot platform assembly 250 then around fixed pulley 466 then around moveable pulley 467 of the foot platform assembly 250. Cable 451 then wraps around fixed pulley 468 then around moveable pulley 469 of the user support assembly 300 then around fixed pulley 470. Cable 451 then wraps around fixed pulley 471 and then is locked into one pulling direction with locking ball 481 shown in FIG. 13. Locking ball 481 locks out against pulley plates 70 and prevents this end of cable 451 from being pulled back towards the weight stack 200. Strap 482 is attached to this end of cable 451 and provides attachment means to strap 442 of the wrist roller assembly 425.

In use, when the foot platform assembly 250 is pressed, pushed, or moved, moveable pulleys 465 and 467 will move upward which will cause cable assembly 450 to lift the selected weight plates 201 of weight stack 200 thus providing resistance to the user. Locking ball 481 will prevent this end of cable 451 from retracting. When the user support assembly 300 is lifted, moveable pulley 469 will move upward which will cause cable assembly 450 to lift the selected weight plates 201 of weight stack 200 thus providing resistance to the user. Locking ball 481 will prevent this end of cable 451 from retracting. When handle bar 427 of the wrist roller assembly 425 is rolled, strap 442 will pull one end of cable assembly 450 upward which will lift the selected weight plates 201 of weight stack 200 thus providing resistance to the user. Those skilled in the art will appreciate that other configurations of pulleys can be used to carry out the present invention. Those skilled in the art will also appreciate that a belt, chain, cord, or other connecting assembly could be used to carry out the present invention. Those skilled in the art will also appreciate that the user support assembly 300 and/or the foot platform assembly 250 could also be directly connected with elastic bands, hydraulic cylinders, pneumatic cylinders, or some other resistance device to provide resistance to the user.

Figure 15:
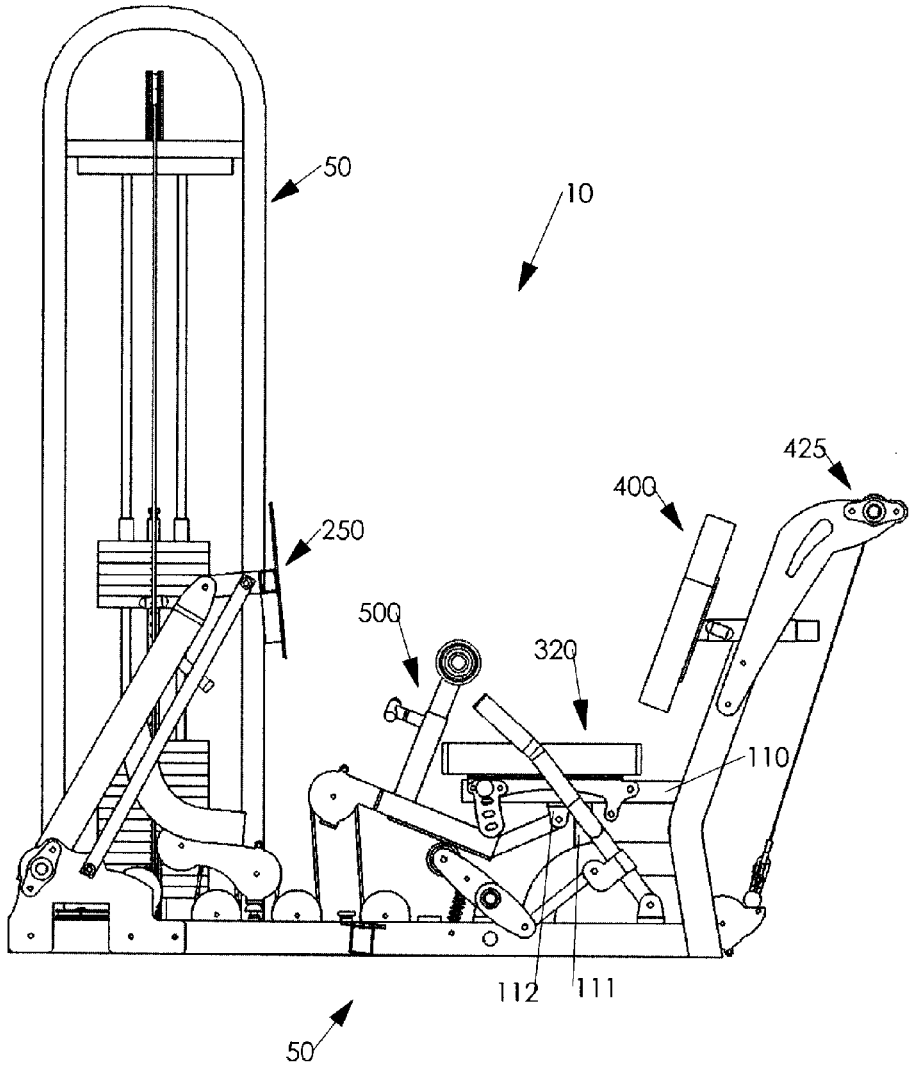
FIG. 15 is a side view illustrating a combination exercise machine and also illustrating an alternate embodiment wherein the seat pad assembly is pivotally attached to the frame, a swing member assembly is pivotally attached to the frame and is in an upward position, and a brace pad assembly is adjusted towards an upward position.
Figure 15:
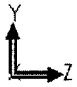
Figure 16:
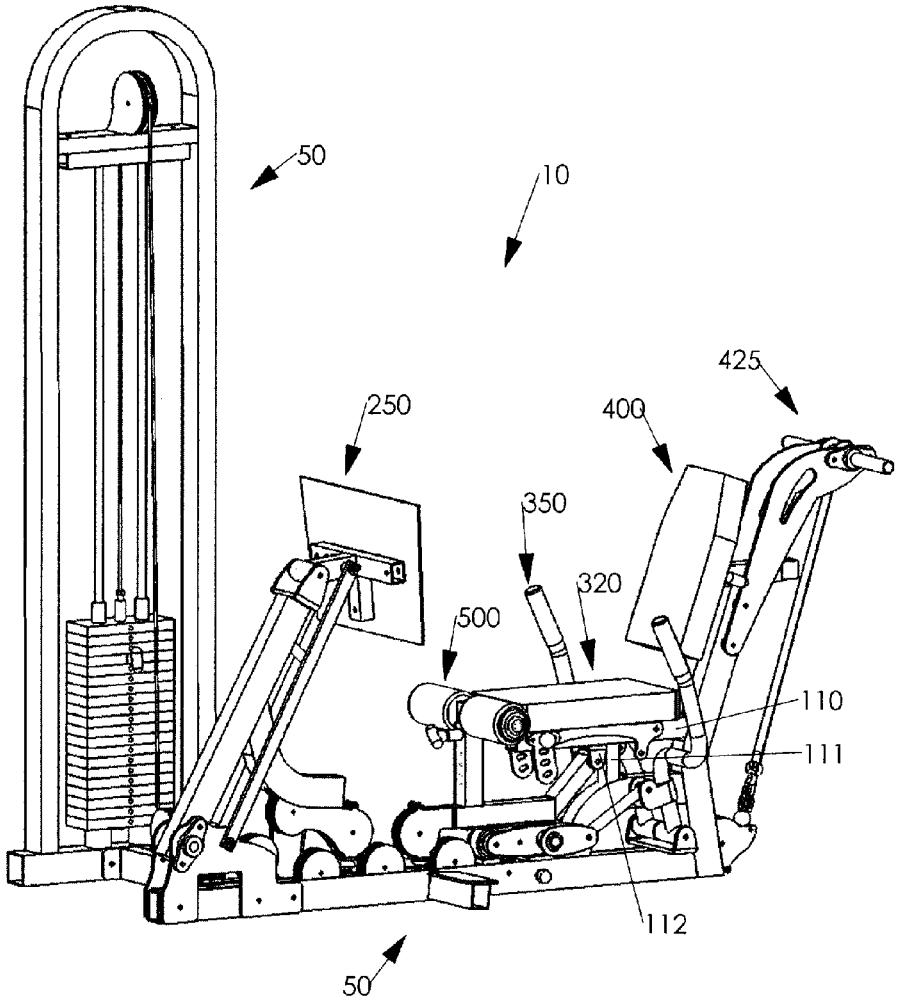
FIG. 16 is a perspective view illustrating a combination exercise machine from the front left side and also illustrating an alternate embodiment wherein the seat pad assembly is pivotally attached to the frame, a swing member assembly is pivotally attached to the frame and is resting in a bumpered position, and a brace pad assembly is adjusted towards a lowered storage position.
Figure 16:
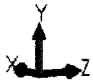
Figure 17:
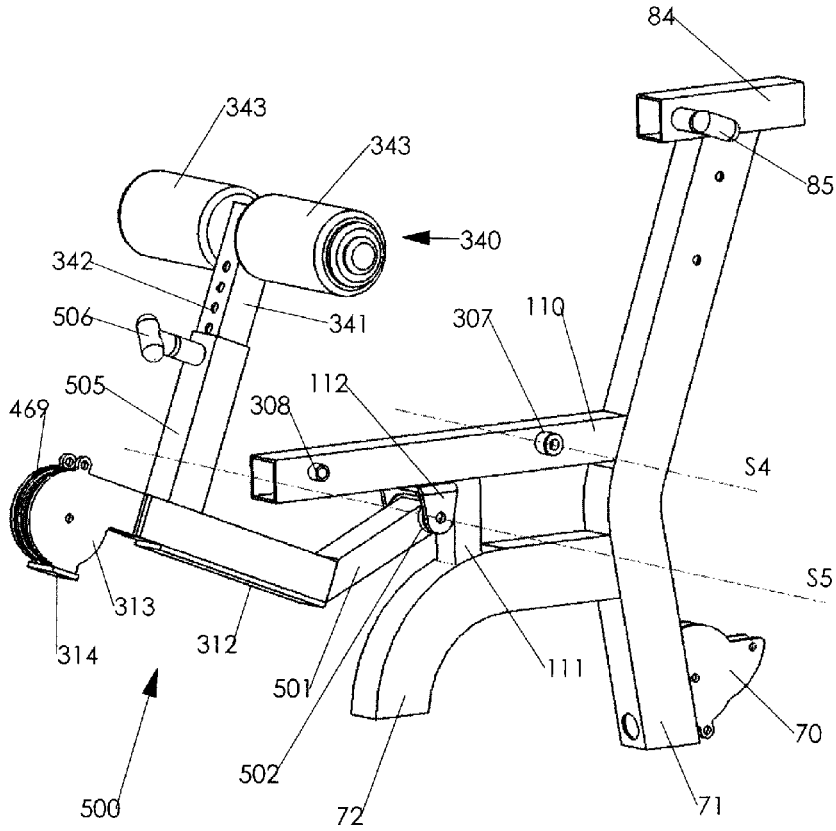
FIG. 17 is a perspective partial view of the frame and a perspective view from the front left side illustrating an alternate embodiment wherein a swing member assembly is pivotally attached to the frame and a brace pad assembly is attached to the swing member assembly and is adjusted to an upward position.
Figure 17:
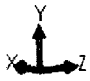

FIGS. 15-17 illustrates an alternate embodiment of combination exercise machine 10 wherein a seat pad assembly 320 is pivotally attached to the frame 50 and is rotatable about axis S4. Those skilled in the art will appreciate that seat pad 321 could be fixedly attached to frame 50 to carry out the present invention. A swing member assembly 500 which includes bent tube 501 and bushing tube 502 is pivotally attached to frame 50 and is rotatable about axis S5 and is also connected with cable assembly 450 to the weight stack 200. A brace pad assembly 340 is adjustably attached to swing member assembly 500. The brace pad assembly 340 can be adjusted by unlocking locking pin 506, sliding brace pad assembly 340 into sleeve 505 to the desired position, and relocking locking pin 506 into the selected aperture 342. The brace pad assembly 340 can be adjusted to a lowered position below the user's legs in order to be out of the way when the user performs leg presses, extended leg calf raises, and chest/tricep presses. To perform isolated seated calf exercises, the brace pad assembly 340 can be adjusted to an upper position wherein the user sits in a seated position and places the brace pads 343 above the knees. The user can then press the multi-function handle bar assembly 350 forward wherein wheel 378 will engage and lift the swing member assembly 500 upward wherein the user can position their feet on frame foot plates 74 mounted below. The user will then release the multi-function handle bar assembly 350 wherein it will return to a rest position. The user then pivots their feet at their ankles in an up and down motion wherein the swing member assembly 500 will then pivot up and down as well. Since the swing member assembly 500 is connected to the weight stack 200 with cable assembly 450, resistance is provided to the user. This procedure will isolate the calf muscles during exercise. The user then can press the multi-function handle bar assembly 350 forward to re-engage the swing member assembly 500 to lift it upward wherein the user can remove their feet off of the frame foot plates 74.

FIG. 16 illustrates combination exercise machine 10 wherein swing member assembly 500 is in a bumpered and rest position and wherein the brace pad assembly 340 is in a lowered position so the user can perform leg presses, extended leg calf raises, or chest/tricep presses. When leg presses, extended leg calf raises, and chest/tricep presses are performed, the swing member assembly 500 remains in a lowered and bumpered position.

FIG. 15 illustrates combination exercise machine 10 wherein swing member assembly 500 is in an upward position and wherein the brace pad assembly 340 is in an upward position for bracing the user's legs above the knees while performing seating isolated calf raises.

Figure 18:
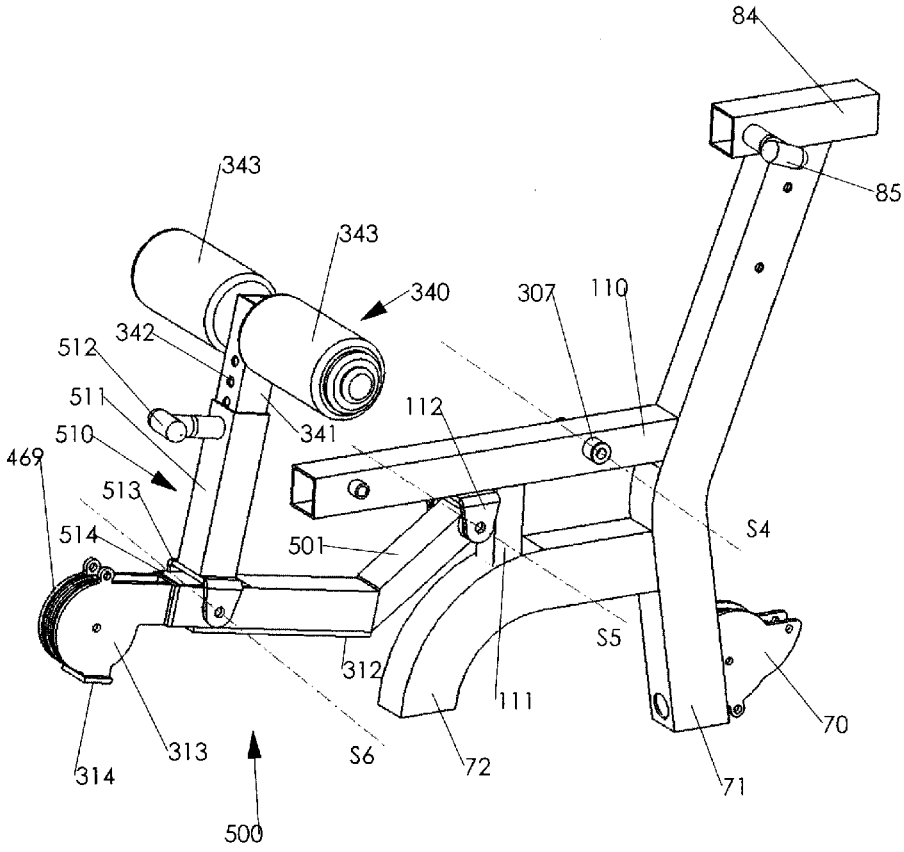
FIG. 18 is a perspective partial view of the frame and a perspective view from the front left side illustrating an alternate embodiment wherein a swing member assembly is pivotally attached to the frame and a brace pad assembly is pivotally and slidingly attached to the swing member assembly.
Figure 18:
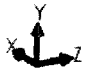

FIG. 18 illustrates an alternate embodiment of swing member assembly 500 wherein sleeve housing assembly 510 is pivotally attached to swing member assembly 500 and is rotatable about axis S6. Sleeve housing assembly 510 comprises sleeve 511 wherein bracket 513 is attached on the bottom end. Brace pad assembly 340 is slidingly adjustable into sleeve housing assembly 510 and can be secured with locking pin 512. Bumper 514 is attached to swing member assembly 500 and bumpers sleeve housing assembly 510.

Figure 19:
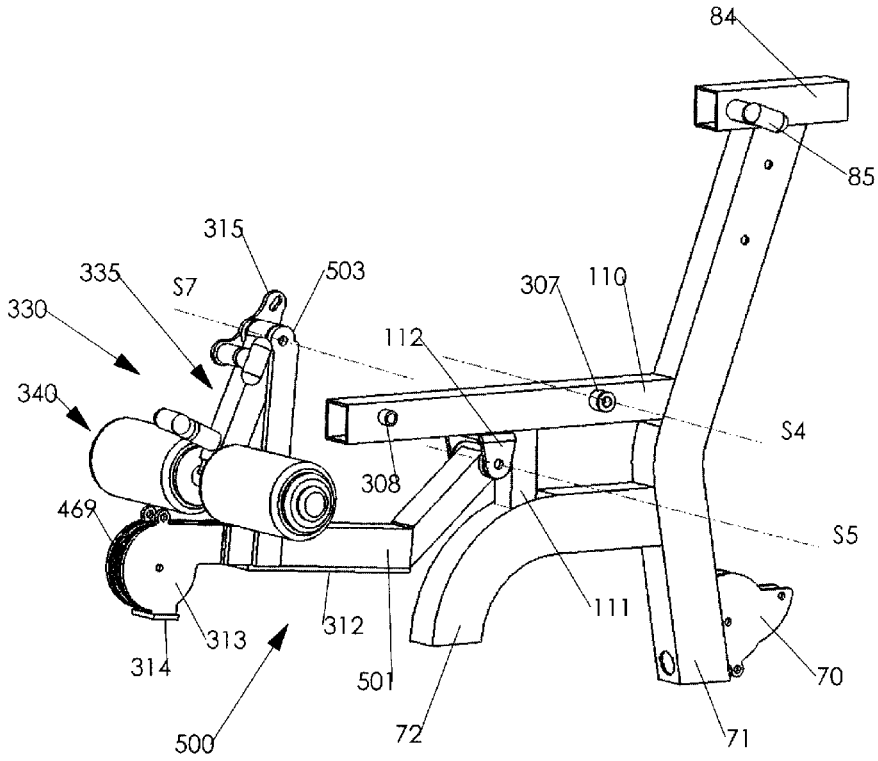
FIG. 19 is a perspective partial view of the frame and a perspective view from the front left side illustrating an alternate embodiment wherein a swing member assembly is pivotally attached to the frame and a brace assembly is pivotally attached to the swing member assembly and the brace pads are adjusted to a downward storage position.
Figure 19:
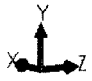

FIG. 19 illustrates an alternate embodiment of swing member assembly 500 wherein brace assembly 330 is pivotally attached to respective brace plates 503 of swing member assembly 500 and is rotatable about axis S7. Those skilled in the art would appreciate that the brace assembly 330 could be used in an upward position or a downward position without being locked into those positions to carry out the present invention.

Figure 20:
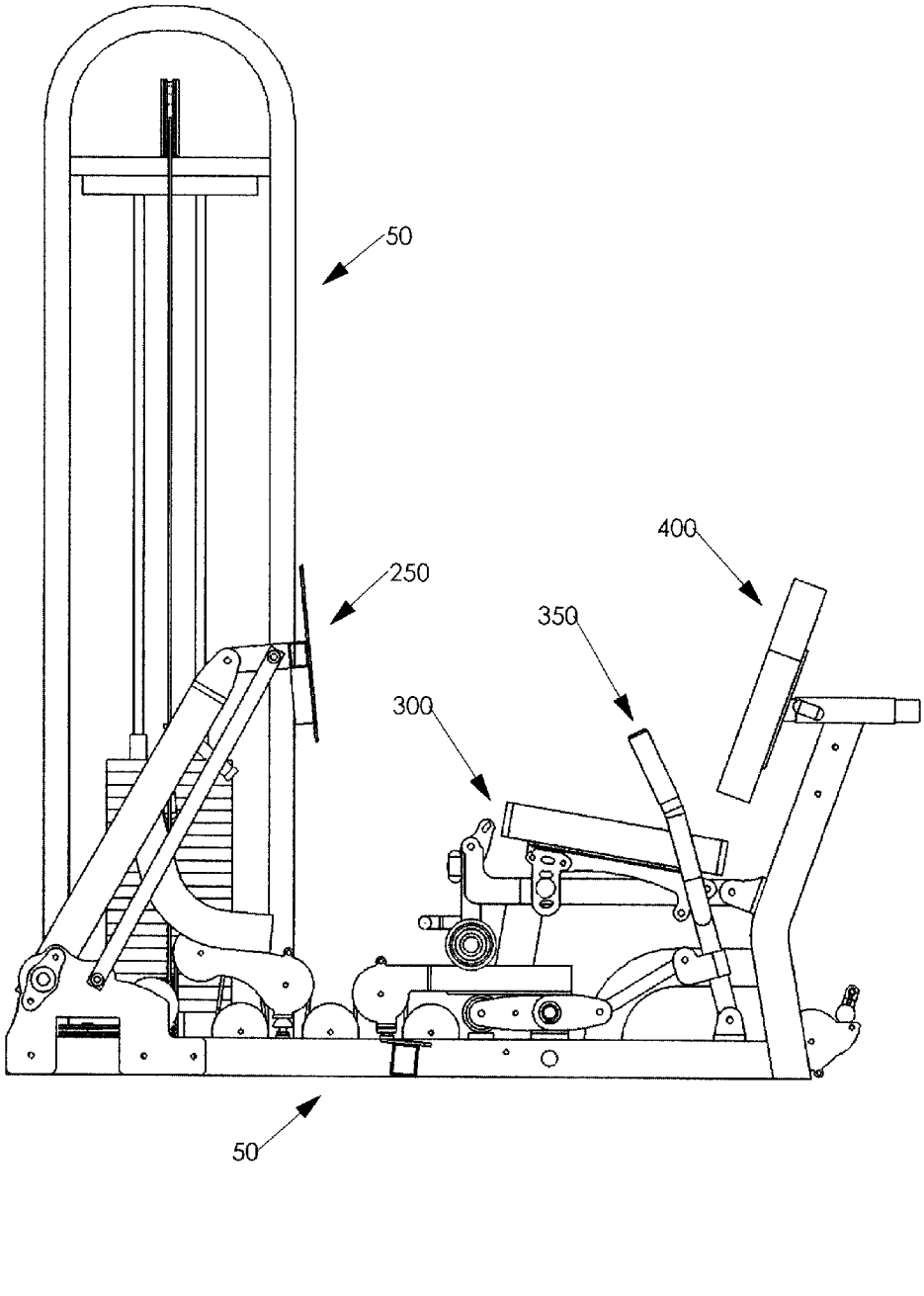
FIG. 20 is a side view illustrating a combination exercise machine wherein leg presses, extended leg calf raises, seating isolated calf raises, and chest/tricep presses can be performed.

FIG. 20 is an alternate embodiment of combination exercise machine 10 wherein the wrist roller assembly 425 is not included.

Figure 21:
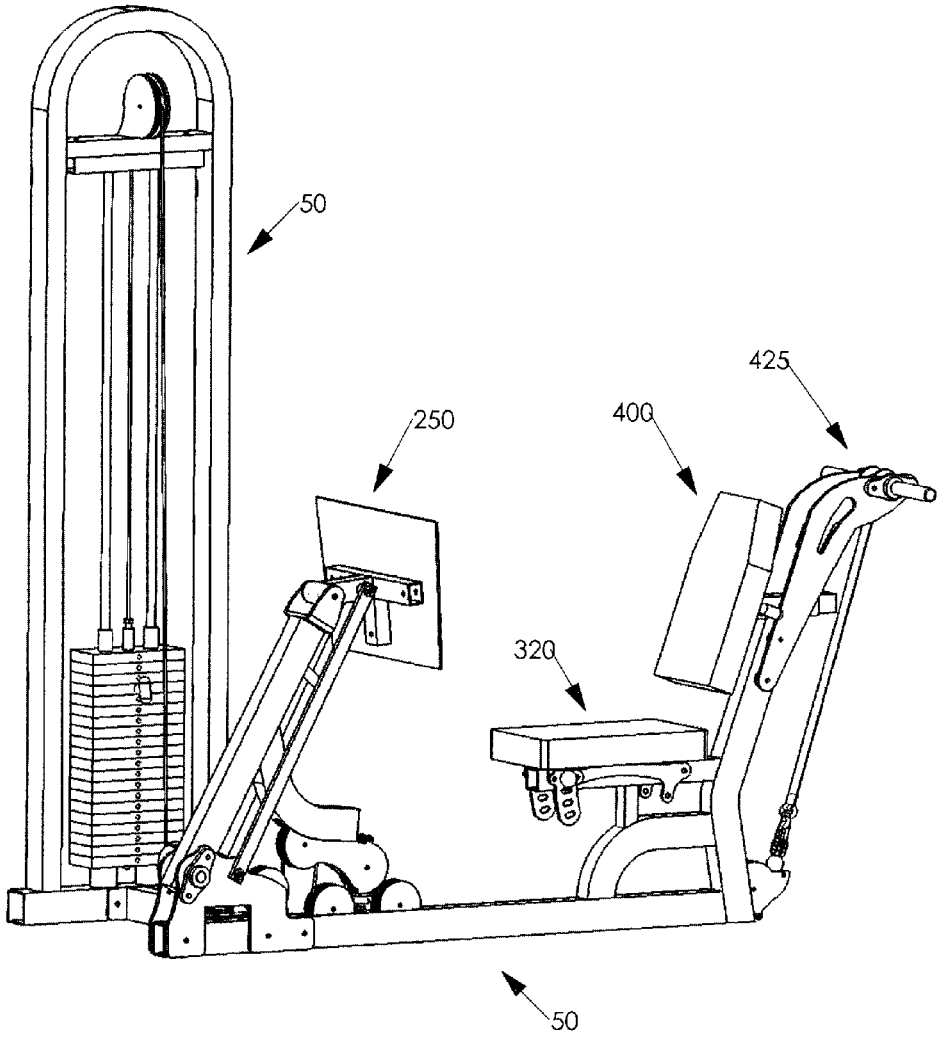
FIG. 21 is a perspective view illustrating a combination exercise machine from the front left side wherein leg presses, extended leg calf raises, and wrist rolling forearm exercises can be performed.
Figure 21:
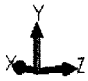

FIG. 21 is an alternate embodiment of combination exercise machine 10 wherein the seat support assembly 305, the brace assembly 330, and the multi-function handle bar assembly is not included.

Figure 22:
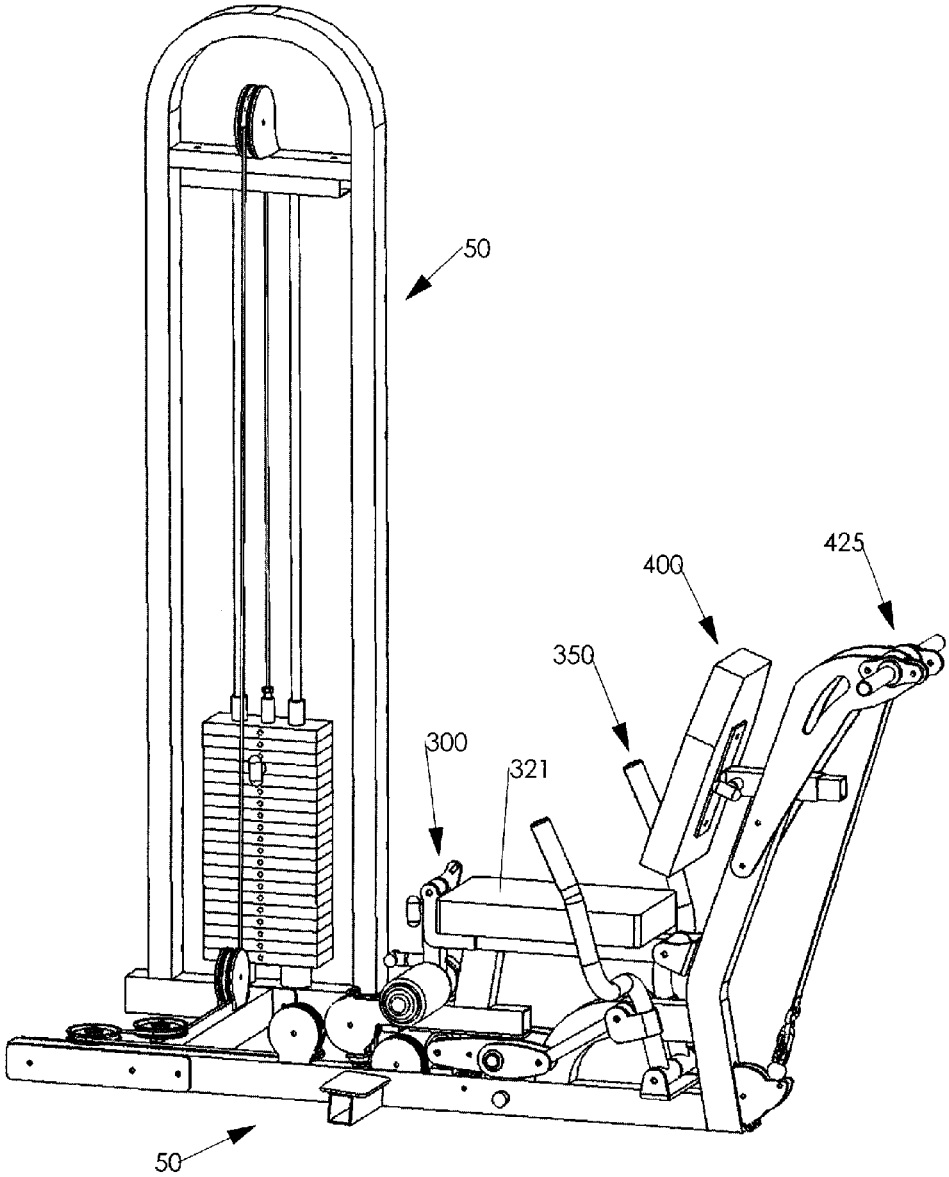
FIG. 22 is a perspective view illustrating a combination exercise machine from the back left side wherein isolated seated calf raises, chest/tricep presses, and wrist rolling forearm exercises can be performed.
Figure 22:
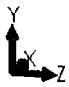

FIG. 22 is an alternate embodiment of combination exercise machine 10 wherein the foot platform assembly 250 and seat pad assembly 320 is not included. Seat pad 321 is fixedly attached to seat support assembly 305.

Figure 23:
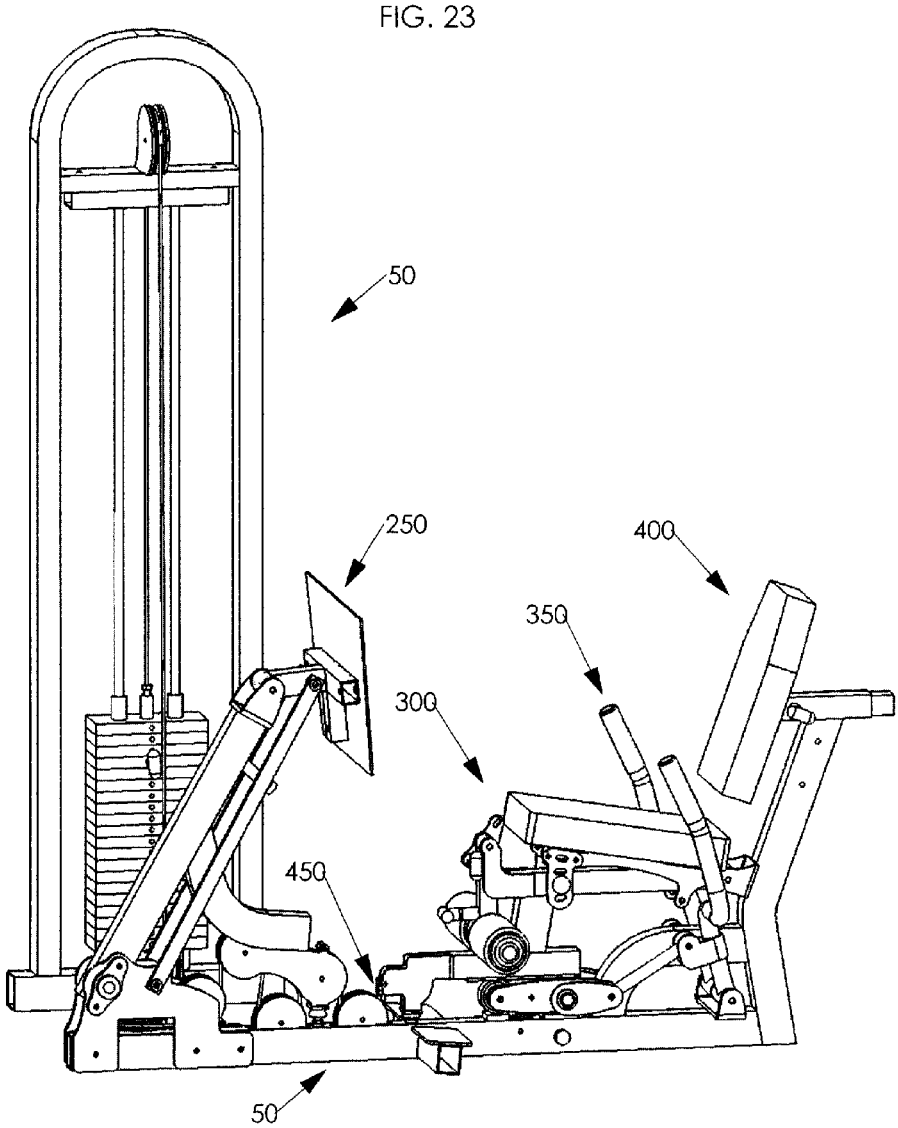
FIG. 23 is a perspective view illustrating a combination exercise machine from the front left side wherein leg presses, extended leg calf raises, seating isolated calf raises, and chest/tricep presses can be performed and also illustrating an alternate embodiment for the cable assembly wherein one end of the cable assembly connects directly into and ends at the seat support assembly.
Figure 23:
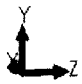

FIG. 23 is an alternate embodiment of combination exercise machine 10 wherein the wrist roller assembly 425 is not included. Also, cable assembly 450 is directly tied into weight stack 200 at one end, and tied directly into seat support assembly 305 at the other end.

Figure 24:
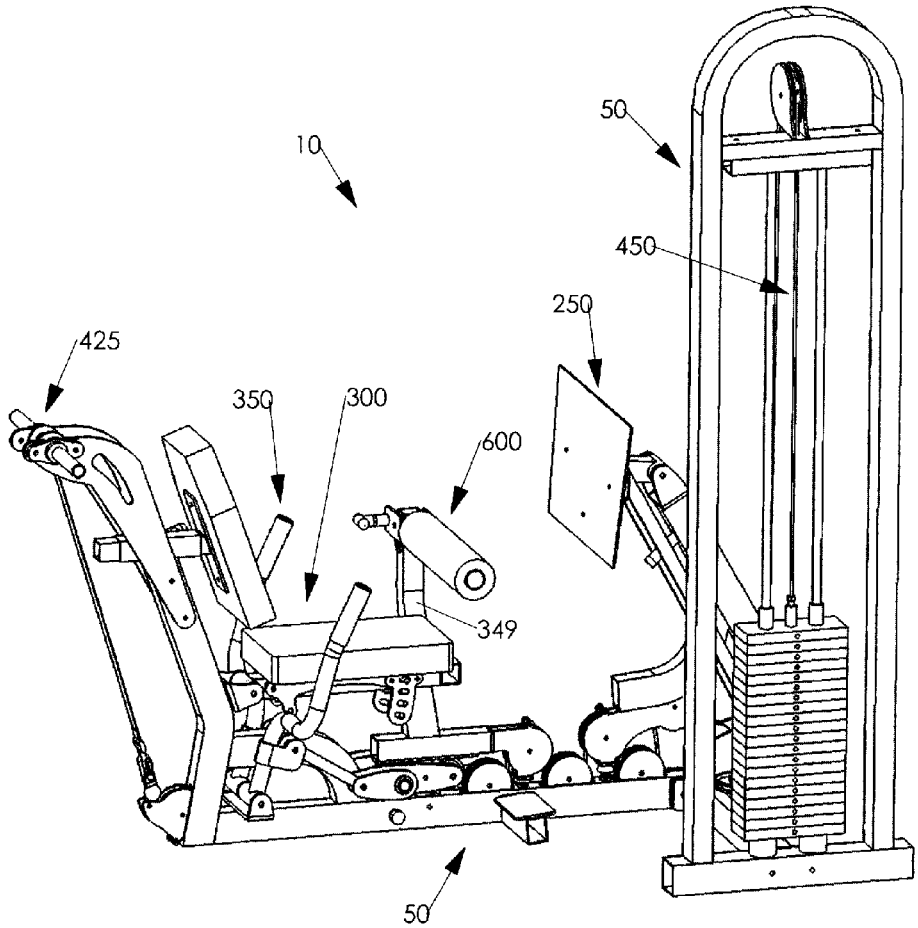
FIG. 24 is a perspective view illustrating a combination exercise machine from the back right side and also illustrating an alternate embodiment wherein an alternate embodiment of a brace assembly is attached to one side of the user support assembly and is adjusted in an upward position for bracing the users legs while performing isolated seated calf exercises.
Figure 24:
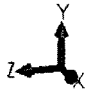

FIG. 24 is an alternate embodiment of combination exercise machine 10 wherein an alternate embodiment of a brace assembly 600 is attached to side extension tube 349 which is part of the user support assembly 300 and is adjusted in an upward position for bracing the users legs while performing isolated seated calf exercises.

Figure 25:
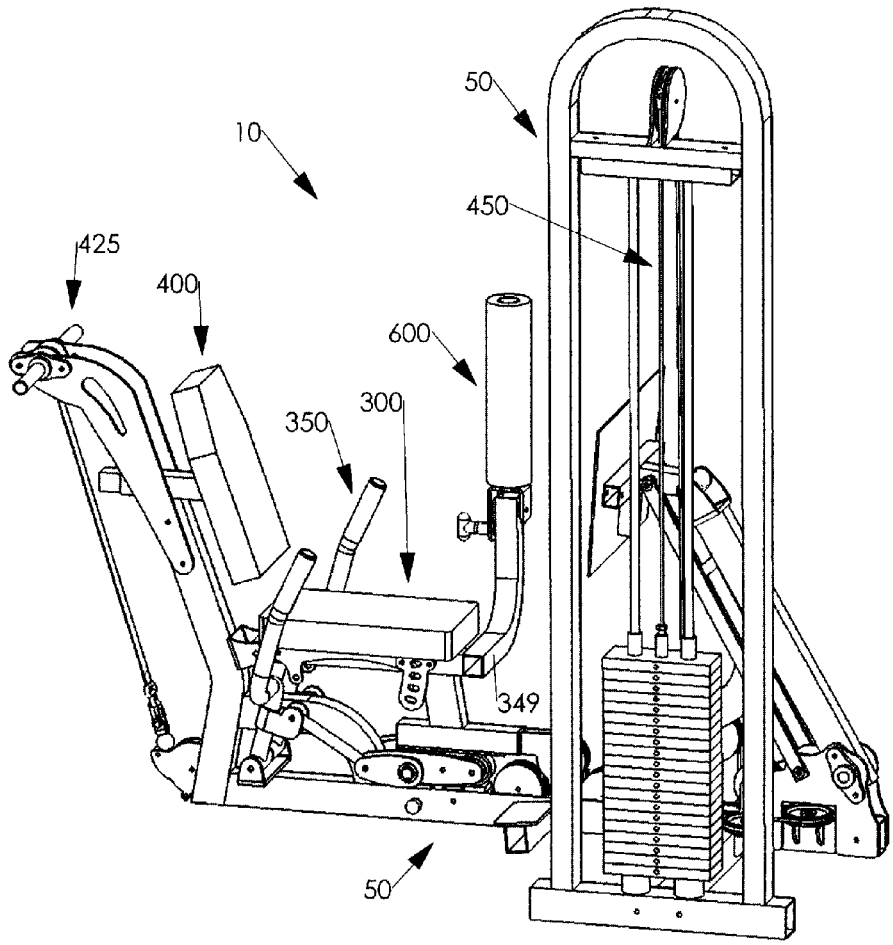
FIG. 25 is a perspective view illustrating a combination exercise machine from the front right side and also illustrating an alternate embodiment wherein an alternate embodiment of a brace assembly is attached to one side of the user support assembly and is adjusted in an upward storage position.
Figure 25:
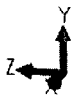

FIG. 25 is an alternate embodiment of combination exercise machine 10 wherein an alternate embodiment of a brace assembly 600 is attached to side extension tube 349 which is part of the user support assembly 300 and is adjusted in an upward storage position.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An exercise apparatus comprising:

a frame;

at least one resistance element to provide resistance for performing exercise;

a user support assembly for supporting a user during exercise, said user support assembly pivotally attached to said frame so as to pivot up and down about a first axis during seated calf raise exercises, said user support assembly connected to said resistance element so that rotation of said user support assembly is resisted by said resistance element;

a foot platform assembly for performing leg press exercises, said foot platform assembly including a first foot platform configured for pressing with the bottom of one or both of said user's feet during leg press exercises, said foot platform assembly connected to said resistance element and pivotable about a second axis;

a second foot platform for supporting the bottom of one or both of said user's feet during seated calf raise exercises, said second foot platform positioned lower than said first foot platform; and a brace pad assembly including at least one brace pad movably mounted to said user support assembly, wherein said brace pad is movable between a first position above said user's knees to support said user's legs during seated calf raise exercises, and a second position below said users legs during leg press exercises.

2. The exercise apparatus of claim 1 wherein said brace pad assembly is pivotally attached to said user support assembly.

3. The exercise apparatus of claim 2 wherein said brace pad assembly is telescopically adjustable.

4. The exercise apparatus of claim 1 wherein said brace pad assembly is slidingly attached to said user support assembly.

5. The exercise apparatus of claim 1 wherein said second foot platform is fixedly attached to said frame.

6. The exercise apparatus of claim 1 wherein said user support assembly includes a seat pad assembly including a seat bottom and wherein said seat pad assembly is pivotally attached to said user support assembly so that said seat bottom is angularly adjustable.

7. The exercise apparatus of claim 1 further comprising a multi-function handle bar assembly pivotally connected to said frame.

8. The exercise apparatus of claim 7 wherein said multi-function handle bar assembly comprises at least one handle interconnected with at least one wheel so that pressing said handle forward will raise said wheel and lift said user support assembly upward.

9. The exercise apparatus of claim 8 wherein one cable interconnects said foot platform assembly with said user support assembly.

10. The exercise apparatus of claim 9 wherein pressing said foot platform assembly will tension said cable and urge said user support assembly into a rest position thus stabilizing said multi-function handle bar assembly into a rest position.

11. The exercise apparatus of claim 1 wherein one cable interconnects said foot platform assembly with said user support assembly.

12. The exercise apparatus of claim 11 wherein the first end of said cable includes a stop member which contacts said frame and provides said first end of said cable a rest position and wherein said cable is interconnected with said resistance element.

13. The exercise apparatus of claim 12 further comprising a wrist roller assembly mounted to said frame behind said user support assembly, said wrist roller assembly including at least one handle rotatable about a third axis for performing forearm exercises.

14. The exercise apparatus of claim 13 further including a flexible member connecting said wrist roller assembly to said first end of said cable, wherein rotating said handle will wrap said flexible member around said wrist roller assembly thus pulling said first end of said cable and therefore displacing said resistance element.

15. The exercise apparatus of claim 14 wherein said flexible member is flat in order to wrap around itself as said handle is rotated.

16. The exercise apparatus of claim 14 wherein said flexible member is a rope.

17. An exercise apparatus comprising:

a frame;

at least one resistance element to provide resistance for performing exercise;

a user support assembly including a seat back and a seat bottom to support a user during exercise;

a foot platform assembly configured for pressing with the bottom of one or both of the user's feet to perform leg press exercises;

a cable interconnecting said foot platform assembly with said resistance element, wherein a first end of said cable includes a stop member which contacts said frame and provides said first end of said cable a rest position;

a wrist roller assembly mounted to said frame behind said user support assembly, said wrist roller assembly including at least one handle rotatable about an axis for performing forearm exercises;

a flexible member connecting said wrist roller assembly to said first end of said cable, wherein rotating said handle will wrap said flexible member around said wrist roller assembly and pull said first end of said cable to urge said foot platform assembly into a rest position and displace said resistance element; and wherein said flexible member is flat in order to wrap around itself as said handle is rotated.

18. The exercise apparatus of claim 17 wherein said flexible member is a rope.

19. An exercise apparatus comprising:

a frame;

at least one resistance element to provide resistance for performing exercise;

a seat back and seat bottom to support a user during exercise;

a swing member assembly pivotally mounted to said frame so as to pivot up and down about a first axis during seated calf raise exercises, said swing member assembly connected to said resistance element so that rotation of said swing member assembly is resisted by said resistance element;

a foot platform assembly for performing leg press exercises, said foot platform assembly including a first foot platform configured for pressing with the bottom of one or both of said user's feet during leg press exercises, said foot platform assembly connected to said resistance element and pivotable about a second axis;

a second foot platform for supporting the bottom of one or both of said user's feet during seated calf raise exercises, said second foot platform positioned lower than said first foot platform; and a brace pad assembly, including at least one brace pad, movably mounted to said swing member assembly, wherein said brace pad is movable between a first position above said user's knees to support said user's legs during seated calf raise exercises, and a second position storing said brace pad assembly during leg press exercises.

20. An exercise apparatus comprising:

a frame;

at least one resistance element to provide resistance for performing exercise;

a user support assembly for supporting a user during exercise, said user support assembly pivotally attached to said frame so as to pivot up and down about a first axis during seated calf raise exercises, said user support assembly connected to said resistance element so that rotation of said user support assembly is resisted by said resistance element;

a foot platform assembly for performing leg press exercises, said foot platform assembly including a first foot platform configured for pressing with the bottom of one or both of said user's feet during leg press exercises, said foot platform assembly connected to said resistance element and pivotable about a second axis;

a second foot platform for supporting the bottom of one or both of said user's feet during seated calf raise exercises, said second foot platform positioned lower than said first foot platform; and a brace pad assembly including at least one brace pad movably mounted to said user support assembly, wherein said brace pad is movable between a first position above said user's knees to support said user's legs during seated calf raise exercises, and a second position storing said brace pad assembly during leg press exercises.

21. An exercise apparatus comprising:

a frame;

at least two resistance elements to provide resistance for performing exercise;

a user support assembly for supporting a user during exercise, said user support assembly pivotally attached to said frame so as to pivot up and down about a first axis during seated calf raise exercises, said user support assembly connected to one of said resistance elements so that rotation of said user support assembly is resisted by said resistance element;

a foot platform assembly for performing leg press exercises, said foot platform assembly including a first foot platform configured for pressing with the bottom of one or both of said user's feet during leg press exercises, said foot platform assembly connected to one of said resistance elements and pivotable about a second axis;

a second foot platform for supporting the bottom of one or both of said user's feet during seated calf raise exercises, said second foot platform positioned lower than said first foot platform; and a brace pad assembly including at least one brace pad movably mounted to said user support assembly, wherein said brace pad is movable between a first position above said user's knees to support said user's legs during seated calf raise exercises, and a second position storing said brace pad assembly during leg press exercises.

22. An exercise machine comprising:

a frame;

at least two resistance elements to provide resistance for performing exercise;

a seat back and seat bottom to support a user during exercise;

a swing member assembly pivotally mounted to said frame so as to pivot up and down about a first axis during seated calf raise exercises, said swing member assembly connected to one of said resistance elements so that rotation of said swing member assembly is resisted by said resistance element;

a foot platform assembly for performing leg press exercises, said foot platform assembly including a first foot platform configured for pressing with the bottom of one or both of said user's feet during leg press exercises, said foot platform assembly connected to one of said resistance elements and pivotable about a second axis;

a second foot platform for supporting the bottom of one or both of said user's feet during seated calf raise exercises, said second foot platform positioned lower than said first foot platform; and a brace pad assembly, including at least one brace pad, movably mounted to said swing member assembly, wherein said brace pad is movable between a first position above said user's knees to support said user's legs during seated calf raise exercises, and a second position storing said brace pad assembly during leg press exercises.

* * * * *